US012264000B2

(12) United States Patent
Mayer

(10) Patent No.: US 12,264,000 B2
(45) Date of Patent: Apr. 1, 2025

(54) CARTON WITH TAMPER-EVIDENT FEATURE AND METHOD OF USING SAME

(71) Applicant: Inno-Pak, LLC, Delaware, OH (US)

(72) Inventor: Steven A. Mayer, Indianapolis, IN (US)

(73) Assignee: Inno-Pak, LLC, Delaware, OH (US)

( * ) Notice: Subject to any disclaimer, the term of this patent is extended or adjusted under 35 U.S.C. 154(b) by 0 days.

(21) Appl. No.: 18/093,655

(22) Filed: Jan. 5, 2023

(65) Prior Publication Data

US 2023/0271747 A1 Aug. 31, 2023

Related U.S. Application Data

(60) Provisional application No. 63/314,075, filed on Feb. 25, 2022.

(51) Int. Cl.
*B65D 5/54* (2006.01)
*B65D 5/66* (2006.01)

(52) U.S. Cl.
CPC ..... *B65D 5/546* (2013.01); *B65D 5/6658* (2013.01); *B65D 2401/15* (2020.05)

(58) Field of Classification Search
CPC .. B65D 5/546; B65D 5/6658; B65D 2401/15; B65D 5/246; B65D 5/665; B65D 5/6661; B65D 5/2047; B65D 5/2057; B65D 5/244; B65D 5/4295; B65D 5/241; B65D 5/2061; B65D 5/24; B65D 5/247; B65D 5/28; B65D 5/563; B65D 2543/00833
USPC ..... 229/228, 148, 186, 155, 126, 151, 157
See application file for complete search history.

(56) References Cited

U.S. PATENT DOCUMENTS

| | | | |
|---|---|---|---|
| 838,964 | A | 12/1906 | Dobson et al. |
| 1,410,404 | A | 3/1922 | Haines |
| 1,537,956 | A | 5/1925 | Meyers |
| D73,127 | S | 7/1927 | Greve |
| 1,792,885 | A | 2/1931 | Andrews |

(Continued)

FOREIGN PATENT DOCUMENTS

| | | | |
|---|---|---|---|
| CN | 2347943 | Y | 11/1999 |
| DE | 2733041 | A1 | 2/1978 |

(Continued)

OTHER PUBLICATIONS

Bowl Sleeve, The Custom Packaging Boxes, Available from internet, https://thecustompackagingboxes.com/boxes-by-style/bowl-sleeve/, 2018, 04 pages.

(Continued)

*Primary Examiner* — Christopher R Demeree
(74) *Attorney, Agent, or Firm* — Ward and Smith, P.A.; Ryan K. Simmons

(57) ABSTRACT

A tamper-evident carton and method of using same. The tamper evident carton may include a floor panel; side panels extending about a periphery of the floor panel; corner gussets extending between adjacent side panels, wherein the floor panel, side panels, and corner gussets may be configurable to form a compartment region; a lid flap extending from an uppermost edge of one of the side panels forming a moveable hinge joint therebetween, the lid flap may include a front edge flap extending from a front edge of the lid flap opposite that of the moveable hinge joint; and a tear strip disposed in the front edge flap.

26 Claims, 18 Drawing Sheets

(56) References Cited

U.S. PATENT DOCUMENTS 1,837,602 A 12/1931 Walter
1,987,545 A 1/1935 Taylor
2,019,870 A 11/1935 Perry
2,050,967 A 8/1936 Farmer
2,062,949 A 12/1936 Taylor
D106,826 S 11/1937 Dieffenbach
2,128,196 A 8/1938 Max
2,149,030 A 2/1939 Arlington
D126,123 S 3/1941 Clemens
2,341,762 A 2/1944 Conklin
2,355,729 A 8/1944 Inman
2,409,736 A 10/1946 Caimi
2,475,294 A 7/1949 Rafoth
D158,362 S 5/1950 Dischler
2,568,170 A 9/1951 Ringler
2,693,836 A 11/1954 Hayes
2,786,572 A 3/1957 Gentry
2,793,801 A 5/1957 John
2,814,381 A 11/1957 Wade
2,823,797 A 2/1958 Harold
2,846,134 A 8/1958 Esber
D183,716 S 10/1958 Burns
2,927,502 A 3/1960 Watrous
2,934,255 A 4/1960 McDuffie
3,008,626 A * 11/1961 Lawrence ..... B65D 5/247 229/188
3,027,063 A 3/1962 Zastrow
D194,246 S 12/1962 Engelmann
3,067,924 A * 12/1962 Baker ..... B65D 5/247 229/160
3,084,790 A 4/1963 Vander Lugt, Jr.
3,101,166 A 8/1963 Van Antwerpen
3,128,030 A 4/1964 Davies
D200,249 S 2/1965 Hancock
3,203,621 A 8/1965 Wright
3,212,907 A 10/1965 Carlo
3,244,353 A 4/1966 Miessler, Sr.
D205,970 S 10/1966 Leifeld
D208,067 S 7/1967 Heirich
3,362,609 A 1/1968 Freedy
3,367,557 A 2/1968 Farquhar
3,372,812 A 3/1968 Parcels
D211,564 S 7/1968 Bailey
3,391,816 A 7/1968 Swett
D212,495 S 10/1968 Stageberg
3,443,681 A 5/1969 Wysocki
D214,523 S 6/1969 Stone
3,462,066 A 8/1969 Farquhar
D217,441 S 5/1970 Kanaga
D219,263 S 11/1970 Castelli et al.
3,559,866 A 2/1971 Olson, Sr.
3,586,173 A 6/1971 Reynolds
3,591,032 A 7/1971 Baxter
3,595,425 A 7/1971 Eicholtz et al.
3,604,614 A 9/1971 Sternfeld
3,610,512 A 10/1971 Hermalin
3,640,380 A 2/1972 Huffman
D224,090 S 7/1972 Cyr et al.
3,701,181 A 10/1972 Lock
3,770,188 A 11/1973 Bressickello
D229,485 S 12/1973 Petersen
3,811,613 A 5/1974 Harrison
D232,302 S 8/1974 Lazure
D232,524 S 8/1974 Schy
D233,083 S 10/1974 Rosa
3,853,220 A 12/1974 Luray
D241,016 S 8/1976 Reynold
3,994,213 A 11/1976 Brezinski
D246,491 S 11/1977 D'Alo
4,063,678 A 12/1977 Hall
4,101,049 A 7/1978 Wallace et al.
4,195,732 A 4/1980 Bell
D255,011 S 5/1980 Cooper et al.
4,243,171 A 1/1981 Prin
D259,615 S 6/1981 Morris, Jr.
4,276,982 A 7/1981 Sibrava et al.
D260,604 S 9/1981 Otto
D263,191 S 3/1982 Moore
4,369,913 A 1/1983 Muise
D276,137 S 10/1984 Vere et al.
D277,555 S 2/1985 Pattillo
4,529,464 A 7/1985 Jones
D280,290 S 8/1985 Bakus
4,596,356 A 6/1986 Chaussadas
4,723,300 A 2/1988 Aranow
4,790,670 A 12/1988 Barbaro
4,832,199 A 5/1989 Rigby
4,844,328 A 7/1989 Cooper
4,846,398 A 7/1989 Johnson
D304,664 S 11/1989 Wyant
4,917,291 A 4/1990 Saiki et al.
4,955,981 A 9/1990 Provost
5,035,515 A 7/1991 Crossman et al.
5,058,744 A 10/1991 Creaden
5,096,113 A 3/1992 Focke
D329,376 S 9/1992 Burd
D334,867 S 4/1993 May
5,226,588 A 7/1993 Schramm et al.
5,226,941 A 7/1993 Uibel et al.
5,310,977 A 5/1994 Stenkamp et al.
5,322,182 A 6/1994 Fritz
D351,997 S 11/1994 Finnah
D352,203 S 11/1994 Campbell et al.
5,411,204 A 5/1995 DeMay
5,415,340 A * 5/1995 Calvert ..... B65D 5/563 229/5.84
5,419,451 A 5/1995 Bitel, Jr.
D363,192 S 10/1995 Rigby et al.
D363,856 S 11/1995 Westbrooks
5,484,059 A 1/1996 Sutherland
D367,172 S 2/1996 Craft et al.
5,507,428 A 4/1996 Robinson, Jr. et al.
D371,940 S 7/1996 Krupa
D372,170 S 7/1996 Ahern
D372,864 S 8/1996 Hansen
D376,953 S 12/1996 Dunn
5,593,755 A 1/1997 Fuss
5,608,949 A 3/1997 Cooley et al.
D381,180 S 7/1997 Butler et al.
D385,080 S 10/1997 Butler et al.
5,711,751 A 1/1998 Harmanoglu
D394,385 S 5/1998 Laughlin
D395,547 S 6/1998 Sussman
5,765,685 A 6/1998 Roosa
D397,294 S 8/1998 Saulas
D398,526 S 9/1998 Schwarz et al.
5,824,380 A 10/1998 Hagan
5,855,275 A 1/1999 Hunter et al.
5,873,220 A 2/1999 Haraldsson et al.
5,881,432 A 3/1999 Good
5,884,783 A 3/1999 Proulx
D409,908 S 5/1999 Besana
5,899,331 A 5/1999 Warren, Jr.
5,927,502 A 7/1999 Hunter
D412,398 S 8/1999 Watabe
5,971,168 A 10/1999 Proulx
D417,364 S 12/1999 Lin
6,142,440 A 11/2000 Gratz et al.
D438,797 S 3/2001 Bozlee
D440,118 S 4/2001 Claffy et al.
D442,085 S 5/2001 Bozlee
D442,859 S 5/2001 Hirschey
D444,703 S 7/2001 Allasia
D445,311 S 7/2001 Emonet et al.
D446,092 S 8/2001 Cautereels
6,269,961 B1 8/2001 Porcelli
6,273,278 B1 8/2001 Enyedy et al.
D448,130 S 9/2001 Wagner
6,286,681 B1 9/2001 Wifong et al.
D451,389 S 12/2001 Bozlee
D451,769 S 12/2001 Stanos et al.
D454,495 S 3/2002 Bryan et al.
6,361,209 B1 3/2002 Larue et al.
D460,689 S 7/2002 Robinson

(56) References Cited

U.S. PATENT DOCUMENTS

D461,406 S 8/2002 Iacovelli
D462,904 S 9/2002 Mellon
6,474,613 B2 11/2002 Omalley
D467,798 S 12/2002 Cohon
6,612,482 B2 9/2003 Ross
D484,364 S 12/2003 Bailey et al.
D484,799 S 1/2004 Hoffman et al.
D490,703 S 6/2004 Rusnock
D495,251 S 8/2004 Zack
D497,309 S 10/2004 Nordland et al.
D499,607 S 12/2004 Lyon
D500,674 S 1/2005 Chou
D501,134 S 1/2005 Takahashi et al.
D502,872 S 3/2005 Fleming
D504,813 S 5/2005 Chou
6,913,389 B2 7/2005 Kannankeril et al.
D509,733 S 9/2005 Jongens
D512,836 S 12/2005 Marnell
7,004,314 B2 2/2006 Pucillo et al.
7,004,632 B2 2/2006 Hamilton et al.
D519,366 S 4/2006 Epstein
D519,830 S 5/2006 Yocum
D521,376 S 5/2006 Mosto
D521,862 S 5/2006 Siethoff et al.
7,090,272 B2 8/2006 Novakovich
D531,498 S 11/2006 Fluegel et al.
D536,612 S 2/2007 Geurts et al.
D542,129 S 5/2007 Moorman
D549,456 S 8/2007 Dretzka
D549,457 S 8/2007 Dretzka
D557,047 S 12/2007 Dretzka
D561,023 S 2/2008 Jacxsens
D561,408 S 2/2008 Marsh
D562,125 S 2/2008 Kienemund-Paroll
D563,673 S 3/2008 Dretzka
D567,671 S 4/2008 Say
D568,765 S 5/2008 Miles
D573,408 S 7/2008 Lovett
D573,409 S 7/2008 Lovett
D576,482 S 9/2008 Debusk
7,427,161 B2 9/2008 Sill et al.
D578,387 S 10/2008 Lovett
D582,268 S 12/2008 Zanaletti
D582,791 S 12/2008 Elmerhaus
D584,108 S 1/2009 Olsson
D590,596 S 4/2009 Dretzka
D595,155 S 6/2009 Larson
D596,027 S 7/2009 Kalberer
D596,448 S 7/2009 Nolan
D596,449 S 7/2009 Nolan
D596,903 S 7/2009 Willis et al.
7,565,997 B1 7/2009 Lim
D599,611 S 9/2009 Hoekstra
D605,896 S 12/2009 Zalewski et al.
D608,153 S 1/2010 Furlong
D615,822 S 5/2010 Klein
D617,636 S 6/2010 Vanhoutte
D622,139 S 8/2010 Marcott et al.
D627,612 S 11/2010 Falk et al.
D630,508 S 1/2011 Hubbard et al.
D630,885 S 1/2011 Stein
D631,352 S 1/2011 Gilfert
D631,741 S 2/2011 Hubbard et al.
D631,742 S 2/2011 Hubbard et al.
D631,743 S 2/2011 Hubbard et al.
D633,341 S 3/2011 Smyers
D635,469 S 4/2011 Buitrago
D637,035 S 5/2011 Zorovich et al.
D641,256 S 7/2011 Fisher
7,984,806 B2 7/2011 Matheou
D642,934 S 8/2011 Ly
D643,311 S 8/2011 Meyers
D645,708 S 9/2011 Stamper et al.
8,033,447 B2 10/2011 Katch
8,061,585 B2 11/2011 Nikolai et al.
D649,838 S 12/2011 Stamper et al.
D652,316 S 1/2012 Ren et al.
D653,496 S 2/2012 Henry
D657,261 S 4/2012 De Gast
D665,271 S 8/2012 Halty et al.
D665,628 S 8/2012 Mayer
D669,352 S 10/2012 Paslawski
D674,690 S 1/2013 Sill
D675,092 S 1/2013 Sill
D675,520 S 2/2013 Sill
D675,920 S 2/2013 Sill
D676,742 S 2/2013 Walter et al.
D678,760 S 3/2013 Cooper
D678,761 S 3/2013 Cooper
D678,762 S 3/2013 Cooper
D678,779 S 3/2013 Lee
D679,950 S 4/2013 Cooper
D682,085 S 5/2013 Hannant et al.
D682,684 S 5/2013 Walter et al.
D684,465 S 6/2013 Vernon et al.
D684,858 S 6/2013 Sill
D688,552 S 8/2013 Vernon et al.
D688,572 S 8/2013 Marin
D688,921 S 9/2013 Miros et al.
D691,035 S 10/2013 Sill
D693,180 S 11/2013 Peterson et al.
D693,215 S 11/2013 Sill
D693,216 S 11/2013 Sill
D693,217 S 11/2013 Sill
D693,218 S 11/2013 Sill
D693,646 S 11/2013 Katterheinrich et al.
D693,679 S 11/2013 Sill
D695,101 S 12/2013 Keberlein et al.
D695,104 S 12/2013 Sill
D695,107 S 12/2013 Clements
D695,575 S 12/2013 Katz
D695,605 S 12/2013 Johnson
D697,789 S 1/2014 Gerdes et al.
D698,644 S 2/2014 Teopas
D699,101 S 2/2014 Strom
D706,128 S 6/2014 Strom
D706,132 S 6/2014 Sill
D707,042 S 6/2014 Ruzzenente
D707,123 S 6/2014 Marchetti et al.
D710,691 S 8/2014 Genender
D712,153 S 9/2014 Lee
D713,725 S 9/2014 Cedeno
D714,638 S 10/2014 Mohn et al.
D718,641 S 12/2014 Ryan et al.
8,939,350 B2 1/2015 Valencia
D726,533 S 4/2015 Northrup
D727,724 S 4/2015 Pipes et al.
D727,732 S 4/2015 Petty
D728,359 S 5/2015 Iwegbu
D728,364 S 5/2015 Baker et al.
D730,178 S 5/2015 Fullan
D731,325 S 6/2015 Loessin
D735,576 S 8/2015 Aldridge
D737,820 S 9/2015 Yu et al.
D739,766 S 9/2015 Glass
D742,759 S 11/2015 Ryan et al.
9,211,970 B2 12/2015 Hubbard et al.
9,212,842 B2 12/2015 Vasbinder et al.
9,216,837 B2 12/2015 Hubbard et al.
D746,643 S 1/2016 Kraemer
D746,671 S 1/2016 Fohner et al.
D752,429 S 3/2016 Mayer
9,309,023 B2 4/2016 Hubbard et al.
D758,184 S 6/2016 Tu et al.
D760,036 S 6/2016 Hucuptan
D763,706 S 8/2016 Shum et al.
D764,276 S 8/2016 Das et al.
D764,281 S 8/2016 Mayer
D766,664 S 9/2016 Wilson et al.
D767,409 S 9/2016 Nickell
9,434,513 B2 9/2016 Lux et al.
D769,114 S 10/2016 Montemayor
D769,732 S 10/2016 Shoshan
D770,270 S 11/2016 Mcgarry et al.

(56) References Cited

U.S. PATENT DOCUMENTS

| | | | | |
|---|---|---|---|---|
| D771,486 | S | 11/2016 | Mayer | |
| D772,053 | S | 11/2016 | Mayer | |
| 9,505,516 | B2 * | 11/2016 | Hubbard, Jr. | B65D 5/2057 |
| D775,946 | S | 1/2017 | Ghini et al. | |
| D776,548 | S | 1/2017 | Bell | |
| D777,029 | S | 1/2017 | Stratton | |
| D778,115 | S | 2/2017 | Strachan | |
| D778,155 | S | 2/2017 | Strachan | |
| D778,722 | S | 2/2017 | Strachan | |
| D779,271 | S | 2/2017 | Simon | |
| D784,769 | S | 4/2017 | Beckman et al. | |
| 9,630,748 | B2 | 4/2017 | Keller | |
| D786,621 | S | 5/2017 | Davis | |
| D786,976 | S | 5/2017 | Keating | |
| D792,160 | S | 7/2017 | Ng | |
| D792,161 | S | 7/2017 | Ng | |
| D792,211 | S | 7/2017 | Foster et al. | |
| D792,222 | S | 7/2017 | Sill et al. | |
| D792,761 | S | 7/2017 | Duval et al. | |
| D793,222 | S | 8/2017 | Boyea | |
| D793,868 | S | 8/2017 | Kim et al. | |
| D798,707 | S | 10/2017 | Mayer | |
| D798,736 | S | 10/2017 | Shoshan | |
| D801,826 | S | 11/2017 | O'Connor et al. | |
| D809,849 | S | 2/2018 | Lee | |
| D809,930 | S | 2/2018 | Kagawa | |
| D809,931 | S | 2/2018 | Kagawa | |
| D811,896 | S | 3/2018 | Wigman et al. | |
| D812,490 | S | 3/2018 | Wigman et al. | |
| D814,929 | S | 4/2018 | Bergeron et al. | |
| D815,941 | S | 4/2018 | Haddad | |
| D815,955 | S | 4/2018 | Park et al. | |
| D818,316 | S | 5/2018 | Disraeli | |
| D821,223 | S | 6/2018 | Tan | |
| D823,486 | S | 7/2018 | Hassan | |
| 10,017,290 | B2 | 7/2018 | Faulkner et al. | |
| D826,043 | S | 8/2018 | Dacey | |
| D828,099 | S | 9/2018 | Zhang | |
| D828,157 | S | 9/2018 | Paradis | |
| D828,763 | S | 9/2018 | Tan | |
| D828,766 | S | 9/2018 | Latour et al. | |
| D829,563 | S | 10/2018 | Park et al. | |
| D830,193 | S | 10/2018 | Park et al. | |
| D830,849 | S | 10/2018 | Tan | |
| D830,852 | S | 10/2018 | Sill et al. | |
| D836,449 | S | 12/2018 | Park et al. | |
| 10,167,134 | B2 | 1/2019 | Zeitlin et al. | |
| D840,232 | S | 2/2019 | Sill et al. | |
| 10,259,616 | B2 | 4/2019 | Korinek et al. | |
| D849,553 | S | 5/2019 | Song et al. | |
| D850,932 | S | 6/2019 | Troudt et al. | |
| D850,933 | S | 6/2019 | Troudt et al. | |
| D854,942 | S | 7/2019 | Requena et al. | |
| D854,943 | S | 7/2019 | Requena et al. | |
| D858,270 | S | 9/2019 | Requena et al. | |
| D860,790 | S | 9/2019 | Sedgwick | |
| D860,807 | S | 9/2019 | Sill | |
| 10,398,243 | B2 | 9/2019 | Sedgwick | |
| D869,289 | S | 12/2019 | Sill et al. | |
| D875,530 | S | 2/2020 | Sill et al. | |
| D876,951 | S | 3/2020 | Sill et al. | |
| 10,829,262 | B2 * | 11/2020 | Sill | B65D 5/241 |
| 11,186,406 | B2 | 11/2021 | Chapman et al. | |
| 11,465,798 | B2 | 10/2022 | Epstein et al. | |
| 2002/0063194 | A1 | 5/2002 | O'malley | |
| 2002/0108955 | A1 | 8/2002 | Erb | |
| 2003/0217946 | A1 | 11/2003 | Hsu | |
| 2004/0182916 | A1 | 9/2004 | Roseth | |
| 2005/0023234 | A1 | 2/2005 | Head | |
| 2005/0041894 | A1 | 2/2005 | Hanson | |
| 2005/0047686 | A1 | 3/2005 | Eisaesser | |
| 2005/0051461 | A1 | 3/2005 | Bryant | |
| 2005/0103674 | A1 | 5/2005 | Matheou | |
| 2005/0124521 | A1 | 6/2005 | Sadlowski et al. | |
| 2005/0150788 | A1 | 7/2005 | Feusner | |
| 2006/0045390 | A1 | 3/2006 | Sill | |
| 2006/0196787 | A1 | 9/2006 | Lewis | |
| 2007/0074993 | A1 | 4/2007 | Philips | |
| 2007/0163449 | A1 | 7/2007 | Hart | |
| 2007/0178194 | A1 | 8/2007 | Everard | |
| 2007/0292053 | A1 | 12/2007 | Lin et al. | |
| 2008/0269034 | A1 | 10/2008 | Stier | |
| 2008/0286431 | A1 | 11/2008 | Brown | |
| 2009/0039144 | A1 * | 2/2009 | Hooi | B65D 5/248 229/148 |
| 2009/0186132 | A1 | 7/2009 | Mangino et al. | |
| 2010/0065620 | A1 | 3/2010 | Smith | |
| 2010/0112292 | A1 | 5/2010 | Gilfert | |
| 2011/0094918 | A1 | 4/2011 | Hernandez | |
| 2011/0120993 | A1 | 5/2011 | Birchmeier et al. | |
| 2011/0240653 | A1 | 10/2011 | Castner et al. | |
| 2012/0234904 | A1 | 9/2012 | Costanzo, Jr. | |
| 2013/0134067 | A1 | 5/2013 | Ramirez et al. | |
| 2013/0315507 | A1 | 11/2013 | Vidal et al. | |
| 2014/0203070 | A1 | 7/2014 | Lee | |
| 2014/0263353 | A1 | 9/2014 | Bell | |
| 2014/0263600 | A1 | 9/2014 | Valencia | |
| 2015/0360821 | A1 | 12/2015 | Greenwood et al. | |
| 2016/0107830 | A1 | 4/2016 | Baryshyan | |
| 2017/0295974 | A1 | 10/2017 | Lai | |
| 2018/0339807 | A1 | 11/2018 | Mobarhan | |
| 2019/0053652 | A1 | 2/2019 | Sedgwick | |
| 2019/0112116 | A1 | 4/2019 | Su et al. | |
| 2019/0322409 | A1 | 10/2019 | Sill et al. | |
| 2019/0367207 | A1 | 12/2019 | Gathercole | |
| 2020/0391903 | A1 | 12/2020 | Donschietz et al. | |
| 2021/0086950 | A1 | 3/2021 | Sill | |
| 2021/0292041 | A1 | 9/2021 | Inwood | |
| 2022/0153469 | A1 * | 5/2022 | Mayer | B65D 5/545 |

FOREIGN PATENT DOCUMENTS

| | | | |
|---|---|---|---|
| DE | 29500157 | U1 | 2/1995 |
| DE | 19831584 | A1 | 1/2000 |
| DE | 10-2009-007985 | A1 | 2/2010 |
| DE | 202010001585 | U1 | 9/2011 |
| EP | 0 515 086 | A1 | 11/1992 |
| FR | 2838406 | A1 | 10/2003 |
| GB | 487330 | A | 6/1938 |
| GB | 2088269 | | 11/1999 |
| JP | 2017-061324 | A | 3/2017 |
| NL | 1040069 | C2 | 8/2014 |
| WO | 2004071890 | A1 | 8/2004 |

OTHER PUBLICATIONS

Food packaging sleeves, Ostle & Maillard, 2019, 04 pages.

Alibaba, "Black Disposable Divided Food Trays", Available from Internet, <URL:https://thai.alibaba.com/product-detail/Airline-disposable-plastic-four-compartment-CPET-1238104653.html>, accessed on Apr. 3, 2017, Oct. 1, 2013, 9 pages.

Alibaba, "Disposable Plastic Two Compartment Food Container", https://wwwalibaba.com/product-detail/Disposable-plastic-two-cornpartment-food-container_60599614850.html, 2018, 8 pages.

Amazon, "DART 205HT2, 9×6×3-Inch Performer White Two Compartment Foam Container with a Removable Hinged Lid, Carryout Food Disposable Containers", Available on amazon.com/DART-205HT2-9x6x3-Inch-Compartment-Disposable/dp/B01LWTYPEW/ref=sr_1_2?keywords=Dart+205HT2&qid=1572602603&sr=8-2, Sep. 12, 2016, 6 pages.

Amazon, "Food Containers 3 Compartment Premium", Available from <URL: https://www.amazon.com/dp/B0741BQMY7/ref=sspa_dk_detail_2?psc=1%20&pd_rd_i=B0741BQMY7&pd_rd_wg=gDStp%20&pd_rd_r=ACEV1YJAC97ZZPCCXWCW&pd_rd_w=XZKtg>, Accessed on Mar. 8, 2018, Jul. 18, 2017, 9 pages.

Amazon, "Freshware Meal Prep Containers [30 Pack] 3 Compartment with Lids, Food Storage Containers, Bento Box | BPA Free | Stackable | Microwave/Dishwasher/Freezer Safe (32 oz)", Feb. 13, 2019, 9 pages.

Amazon, "Pactiv RCL750200, 3-Compartment Aluminum Foil Pans Combo with Flat Foil Lids, Take Out Disposable Foil Containers

(56) References Cited

OTHER PUBLICATIONS with Matching Covers", Available at https://www.amazon.com/Pactiv-RCL750200-3-Compartment-Disposable-Containers/dp/B01LXOJ7BP/ref=sr_1_1?keywords=Pactiv+RCL750200&qid=1572606252&sr=8-1, Sep. 28, 2016, 5 pages.
Amazon, "Southern Champion Tray 0731 #1 ChampPak Classic Take-Out Container, Kraft Paperboard Coated Inside", Southern Champion Tray, Jan. 17, 2013, 1 page.
Amazon, "Southern Champion Tray 23133K Kraft Paperboard Lock Corner Window Bakery Box", Available from internet https://www.amazon.com/gp/product/B008WCWJ9S/ref=s9_zwish_hd_bw_g328_i1?pf_rd_m=ATVPDKIKXODER&pf_rd_s=merchandised-search-5&pf_rd_r=OF299N2PNPMAY8WZM12D&pf_rd_t=101&pf_rd_p=2223275202&pf_rd_i=5016466011, Mar. 15, 2013, 1 page.
amazon.com, "50 Paper Food to Go Containers—51oz—New Design with Waist Seal Band—Eco Friendly Disposable Kraft Paper Take Out Food Container—Sturdy Leak & Grease Proof Microwavable Take Away Boxes", retrieved from web on Nov. 5, 2019, available on https://www.amazon.com/Paper-Food-Containers-Disposable-Microwavable/dp/B07M74VWXW, 6 pages.
Blair Candy, "Empty Candy Boxes", Available at https://www.blaircandy.com/emcabo.html, accessed on Oct. 30, 2015, 2013, 1 page.
Dean Supply, "Disposable Takeout Containers", Jul. 18, 2017, 9 pages.
Flex Active Sports, "Buy 3-Compartment Food Prep Containers", Available from Internet, <URL:http://flexactivesports.com/buy-3-compartment-food-prep-containers/>, accessed on Apr. 17, 2017, Jan. 5, 2016, 14 pages.
Glynn Robin, "Origami Treasure Chest", Available at https://www.youtube.com/watch?v=WpgGqeBQvj4, accessed on Oct. 30, 2015, Nov. 29, 2010, 1 page.
Importitall, "Southern Champion Tray 0761 #1", ChampPak Retro Take-Out, Jul. 13, 2017, 1 page.
Importitall, "Southern Champion Tray 0764 #4", ChampPak Retro Take-Out, Jul. 13, 2017, 1 page.
Inno-Pak, "Innobox Edge Insert", Oct. 25, 2016, 3 pages.
JCPAK, "Cardboard Sleeves for Food Tray", Cartons and Boxes, Available from Internet, http://www.jchengpackage.com/Cartons_and_Boxes/28.html, 2018, 02 pages.
Kalifornia Love, "Extra Fruit Sensations Sweet Watermelon", Available at http://www.kalifornialove.com/2010/07/extra-fruit-sensations-sweet-watermelon.html, accessed on Nov. 4, 2016, Jul. 28, 2010, 20 pages.
Nearof, "Review: Stride Spark Vitamin Chewing Gum", Available at http://www.nearof.com/review-stride-spark-vitamin-chewing-gum/, accessed on Nov. 4, 2016, Sep. 7, 2011, 4 pages.
Placon, "Fresh n Clear Go Cubes Black Insert Tray", https://www.placon.com/products/stock-food-package/fresh-n-clear-gocubes-black-insert-tray/>, 2016, 2 pages.
Robives, "Curved Lid Box", Nov. 2, 2013, 1 page.
Sabert, "Pulp Divided Taco Tray Insert", Available at https://www.sabert.com/products/pulp-divided-taco-tray-insert, Accessed on Mar. 27, 2019, Mar. 27, 19, 7 pages.
Shutterstock, "Empty Food Tray Sleeve Packaging with Handles and Blueprint Template", Available from Internet, https://www.shutterstock.com/image-illustration/empty-food-tray-sleeve-packaging-handles-288654425?rid=928534, 08 pages.
Splash Packaging, "Natural Kraft Windowed Boxes", Available from internet, https://www.splashpackaging.com/window-bakery-boxes-kraft.html, Oct. 4, 2014, 1 page.
The Delaware Gazette, "Inno-Pak is Staying Put", Available at https://www.delgazette.com/news/295/inno-pak-is-staying-put, accessed on Dec. 11, 2015, Jun. 13, 2015, 1 page.
The Dumbbelle, "Fitness Meal Prep Containers for Healthy Living", Available at https://thedumbbelle.com/fitness-meal-prep-containers/, accessed on May 3, 2019, 9 pages.
Webstaurant Store, "Cambro 9113CW414 Camwear Teal 9" ×11" 3 Compartment Meal Delivery Tray", Available from <URL: https://www.webstaurantstore.com/cambro-9113cw414-camwear-teal-9-x-11-3-compartment-meal-delivery-tray-case/2149113CWTE.html>, accessed on Apr. 17, 2017, Mar. 14, 2010, 4 pages.
webstaurantstore.com, "Choice 7 3/4" ×5 1/2" ×2" Kraft Microwavable Folded Paper #2 Take-Out Container—200/Case", retrieve from web on Nov. 5, 2019, available on https://www.webstaurantstore.com/choice-8-1-2-x-6-x-2-kraft-microwavable-folded-paper-2-take-out-container-case/795PTOKFT2.html, 6 pages.
Westrock, "FOLD-PAK—Bio-Plus Earth", retrievedfrom web on Nov. 5, 2019, available on http://www.fold-pak.com/products/Bio-PlusEarth.htm, 2 pages.
Youtube, "Inno-Pak Rigid Microwavable Take Out Containers", Available from <URL:https://www.youtube.com/watch?v=WolGFg_sHSk>, accessed on Feb. 2, 2017, Sep. 17, 2014, 1 page.
International Search Report and Written Opinion from International Application No. PCT/US2019/030891, dated Jul. 26, 2019, 13 pages.
Made-in-China. Small Custom Design Kraft Food Gift Origami Paper Packaging Box with Lid. Publication date unavailable. Visited Nov. 23, 2021. https://engytech.en.made-in-china.com/product/zygqnjLdSQXVo/China-Factory-Price-Small-Custom-Design-Kraft-Food-Gift-Origami-Paper-Packaging-Box-with-Lid.html (Year: 0).
Inno-Pak Handle Cuffs; Announced Aug. 24, 2020 (online). Site visited [Oct. 20, 2021]. Available from internet URL: https://www.Innopak.com/products/handle-cuffs/.

* cited by examiner

CARTON WITH TAMPER-EVIDENT FEATURE AND METHOD OF USING SAME

RELATED APPLICATIONS

This application is related and claims priority to U.S. Provisional Patent Application No.: 63/314,075, filed Feb. 25, 2022, the application of which is incorporate herein by reference in its entirety.

TECHNICAL FIELD

The subject matter relates generally to food containers and more particularly to a carton with tamper-evident feature and method of using same.

BACKGROUND

Various products are known to be purchased by consumers which require a container for ease of transport. For example, in the food and grocery industry it is common to place food items in individual carry-out food containers. There may be certain drawbacks to commonly used carry-out food containers. For example, cardboard-, paper-, and/or paperboard-based containers may be designed in a fashion that cannot ensure that the contents have been held secure in an untampered with state.

SUMMARY

In one embodiment, a tamper evident carton is provided. The tamper evident carton may include a floor panel; side panels extending about a periphery of the floor panel; corner gussets extending between adjacent side panels, wherein the floor panel, side panels, and corner gussets may be configurable to form a compartment region; a lid flap extending from an uppermost edge of one of the side panels forming a moveable hinge joint therebetween, the lid flap may include a front edge flap extending from a front edge of the lid flap opposite that of the moveable hinge joint; and a tear strip disposed in the front edge flap. The side panels may include a front side panel, an opposing rear side panel, a first end panel, and an opposing second end panel, and wherein the lid flap extends from an uppermost edge of the rear side panel. The front side panel may include a front side top edge flap and the opposing first and second end panels may include a first end top edge flap and a second end top edge flap, respectively, wherein the front side top edge flap, the first end top edge flap, and the second end top edge flap may be hingedly connected to a top edge of their respective panel, and wherein one or more of the front side top edge flap, first end top edge flap, and second end top edge flap may include a receiving tab formed therein. The lid flap may include one or more locking tabs, wherein the one or more locking tabs may be configured to engage with the receiving tab of one or more of the front side top edge flap, first end top edge flap, and second end top edge flap. The moveable hinge joint formed between the lid flap and the uppermost edge of its respective side panel may be perforated. The front edge flap may further include a coupling portion, wherein the coupling portion may be configured to affix to at least a portion of an outer facing surface of the front side panel, and wherein the tear strip may extend a length of the front edge flap and may be disposed between the coupling portion and the front edge of the lid flap. The tamper evident carton may further include a first score line and a second score line, wherein the first score line and the second score line define side boundaries of the tear strip, and wherein each of the first score line and the second score line may be flanked by a third score line and a fourth score line, respectively. The first score line and the second score line may be cut about fifty percent (50%) through from an inside surface of the front edge flap, and wherein the third score line and the fourth score line may be cut about fifty percent (50%) through from an outside surface of the front edge flap. Wherein upon removal of the tear strip the coupling portion may be separated from the front edge of the lid flap. The one or more locking tabs may be configured to be interlockable with a corresponding receiving tab of one or more of the front side top edge flap, first end top edge flap, and second end top edge flap when the lid flap is in a closed configuration. Wherein once interlocked the interlocked locking tab and receiving tab may be configured such that the locking tab cannot be removed from the receiving tab without causing visible damage to at least one of the locking tab and the receiving tab. Wherein the coupling portion may be affixable to the front side panel via an adhesive.

In another embodiment, a method of securing contents in a tamper evident carton is provided. The method may include providing a tamper evident carton. The tamper evident carton may include a floor panel; side panels extending about a periphery of the floor panel; corner gussets extending between adjacent side panels, wherein the floor panel, side panels, and corner gussets are configurable to form a compartment region; a lid flap extending from an uppermost edge of one of the side panels forming a moveable hinge joint therebetween, the lid flap comprising a front edge flap extending from a front edge of the lid flap opposite that of the moveable hinge joint; and a tear strip disposed in the front edge flap. The method may further include inserting contents into the compartment region; folding the lid flap to a closed position; and securing the front edge flap to a side panel opposite that of the side panel from which the front edge flap extends from. The side panels of the tamper evident carton may include a front side panel, an opposing rear side panel, a first end panel, and an opposing second end panel, and wherein the lid flap extends from an uppermost edge of the rear side panel. The front side panel may include a front side top edge flap and the opposing first and second end panels may include a first end top edge flap and a second end top edge flap, respectively, wherein the front side top edge flap, the first end top edge flap, and the second end top edge flap may be hingedly connected to a top edge of their respective panel, and wherein one or more of the front side top edge flap, first end top edge flap, and second end top edge flap may include a receiving tab formed therein. The lid flap may include one or more locking tabs, and wherein the one or more locking tabs may be configured to engage with the receiving tab of one or more of the front side top edge flap, first end top edge flap, and second end top edge flap. The method may further include interlocking one or more of the one or more locking tabs with a corresponding receiving tab of one or more of the front side top edge flap, first end top edge flap, and second end top edge flap. The front edge flap may further include a coupling portion, wherein the coupling portion may be configured to affix to at least a portion of an outer facing surface of the front side panel, and wherein the tear strip extends a length of the front edge flap and may be disposed between the coupling portion and the front edge of the lid flap. The tear strip may include a first score line and a second score line defining side boundaries thereof, and wherein each of the first score line and the second score line may be flanked by a third score line and a fourth score line, respectively. The first score line and the second score line may be cut about fifty percent (50%) through from an inside surface of the front edge flap, and wherein the third score line and the fourth score line may be cut about fifty percent (50%) through from an outside surface of the front edge flap.

In yet another embodiment, a method of securing contents in a tamper evident carton is provided. The method may include providing a tamper evident carton. The tamper evident carton may include a floor panel; side panels extending about a periphery of the floor panel; corner gussets extending between adjacent side panels, wherein the floor panel, side panels, and corner gussets are configurable to form a compartment region; a lid flap extending from an uppermost edge of one of the side panels forming a moveable hinge joint therebetween, the lid flap comprising a front edge flap extending from a front edge of the lid flap opposite that of the moveable hinge joint; and a tear strip disposed in the front edge flap. The method may further include removing the tear strip; and folding open the lid flap. The side panels of the tamper evident carton may include a front side panel, an opposing rear side panel, a first end panel, and an opposing second end panel, and wherein the lid flap extends from an uppermost edge of the rear side panel. The front side panel may include a front side top edge flap and the opposing first and second end panels may include a first end top edge flap and a second end top edge flap, respectively, wherein the front side top edge flap, the first end top edge flap, and the second end top edge flap may be hingedly connected to a top edge of their respective panel, and wherein one or more of the front side top edge flap, first end top edge flap, and second end top edge flap may include a receiving tab formed therein. The lid flap may include one or more locking tabs, and wherein the one or more locking tabs may be configured to engage with the receiving tab of one or more of the front side top edge flap, first end top edge flap, and second end top edge flap. The method may further include, prior to folding open the lid flap, unlocking the one or more of the one or more locking tabs that are interlocked with a corresponding receiving tab of one or more of the front side top edge flap, first end top edge flap, and second end top edge flap. The front edge flap may further include a coupling portion, wherein the coupling portion may be configured to affix to at least a portion of an outer facing surface of the front side panel, and wherein the tear strip extends a length of the front edge flap and may be disposed between the coupling portion and the front edge of the lid flap. The tear strip may include a first score line and a second score line defining side boundaries thereof, and wherein each of the first score line and the second score line may be flanked by a third score line and a fourth score line, respectively. The first score line and the second score line may be cut about fifty percent (50%) through from an inside surface of the front edge flap, and wherein the third score line and the fourth score line may be cut about fifty percent (50%) through from an outside surface of the front edge flap. Wherein upon removal of the tear strip the coupling portion may be separated from the front edge of the lid flap.

BRIEF DESCRIPTION OF THE DRAWINGS

Figure 1:
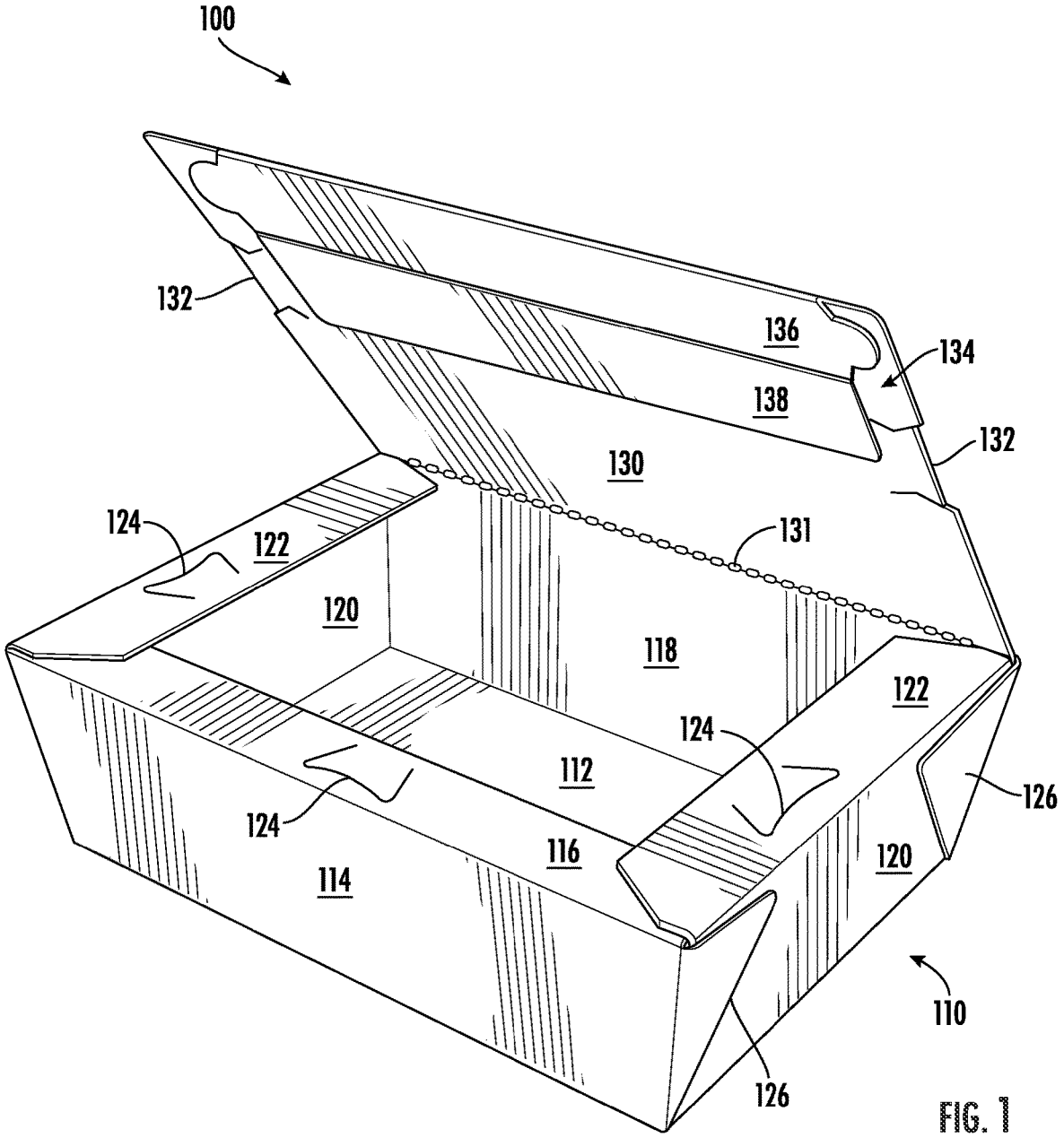
Figure 2:
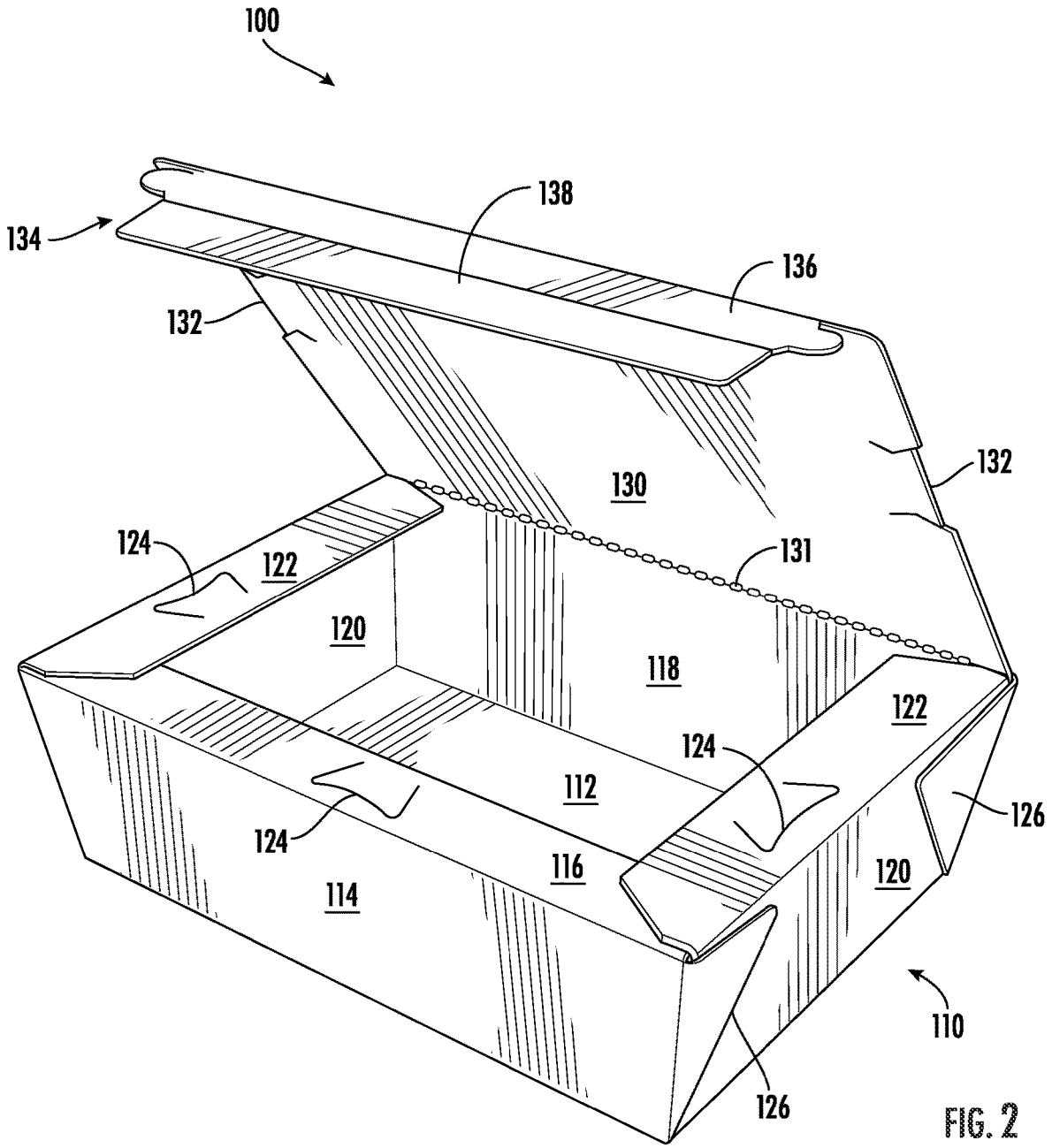
Figure 3:
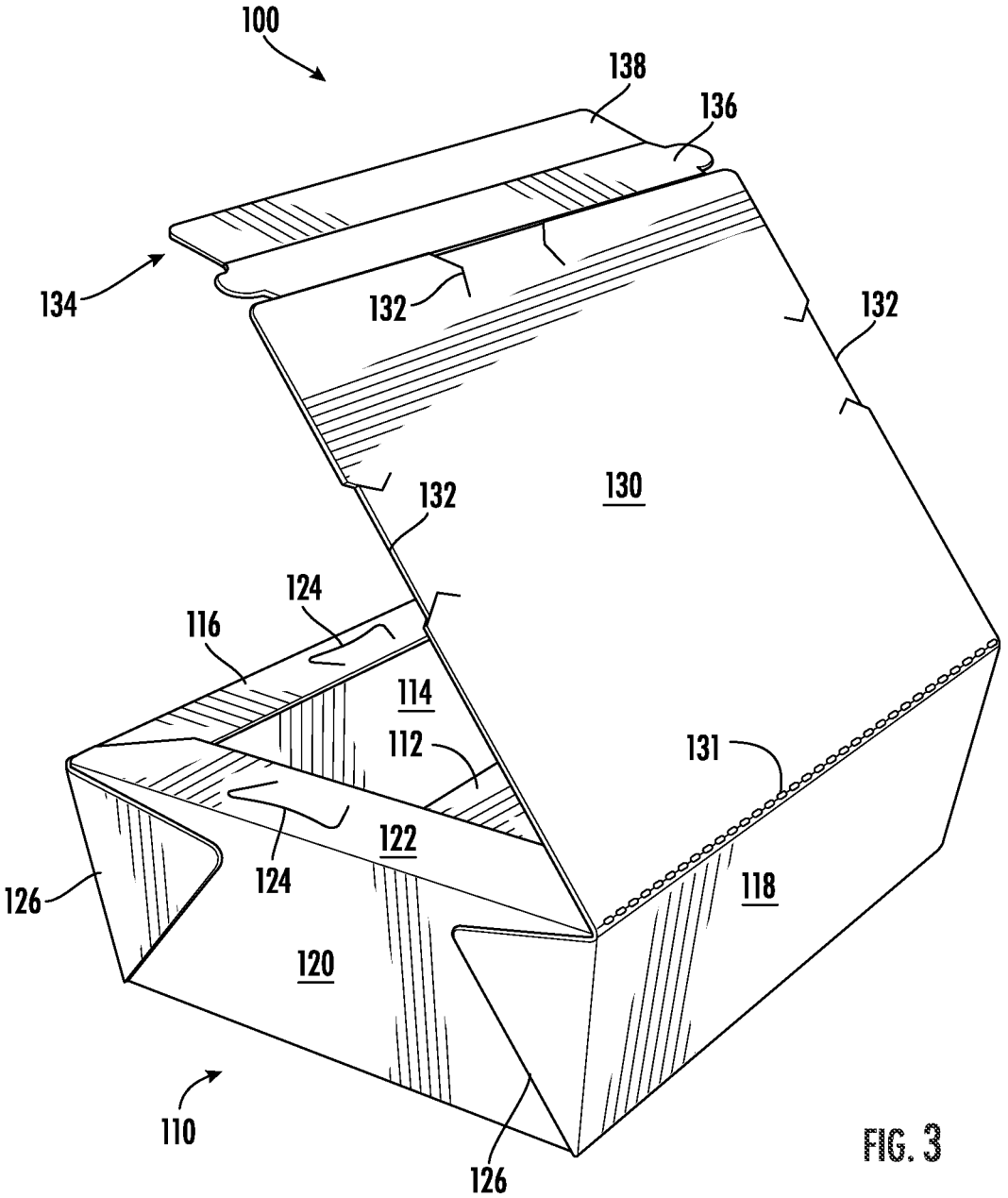
Figure 4:
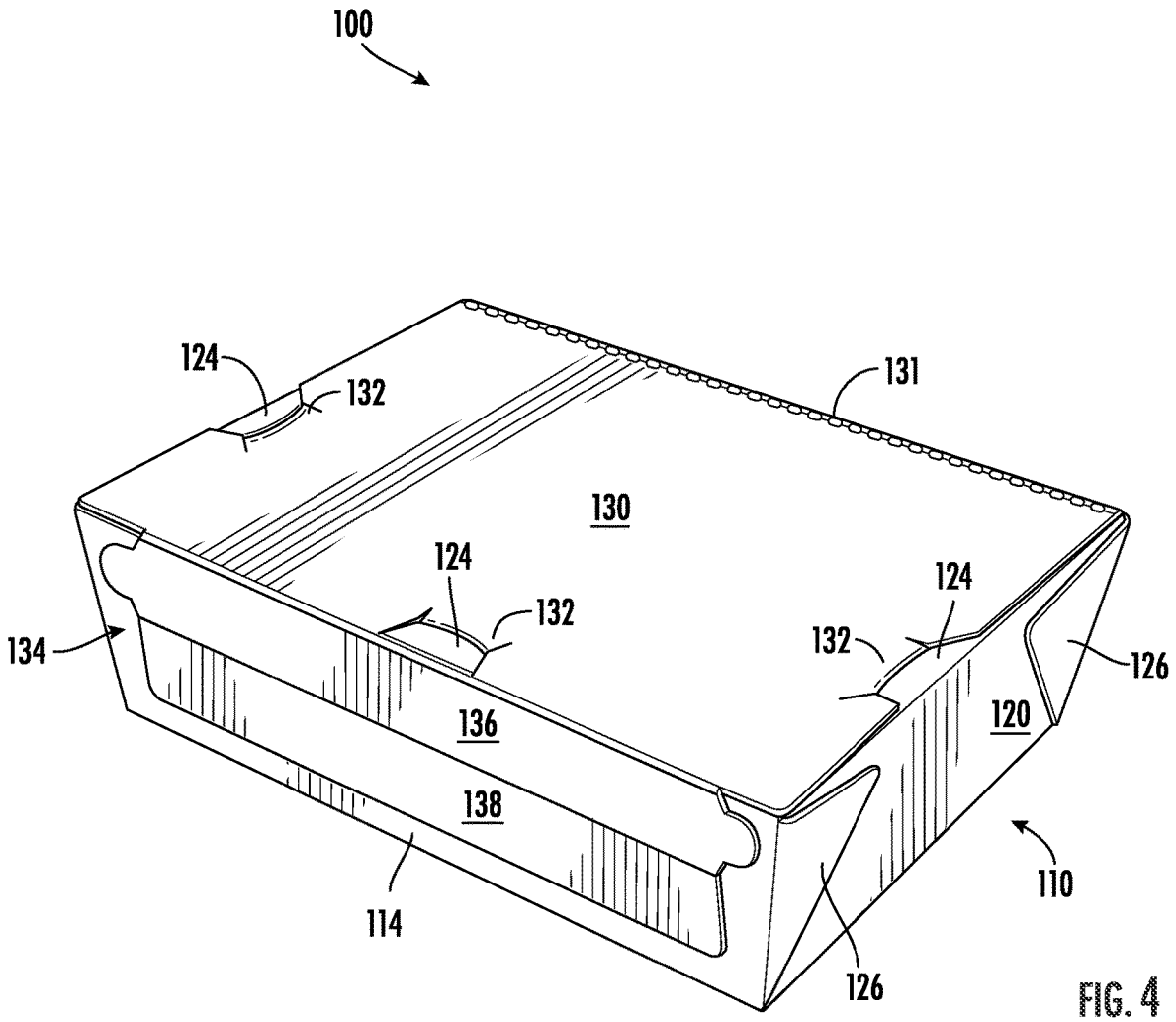
Figure 10:
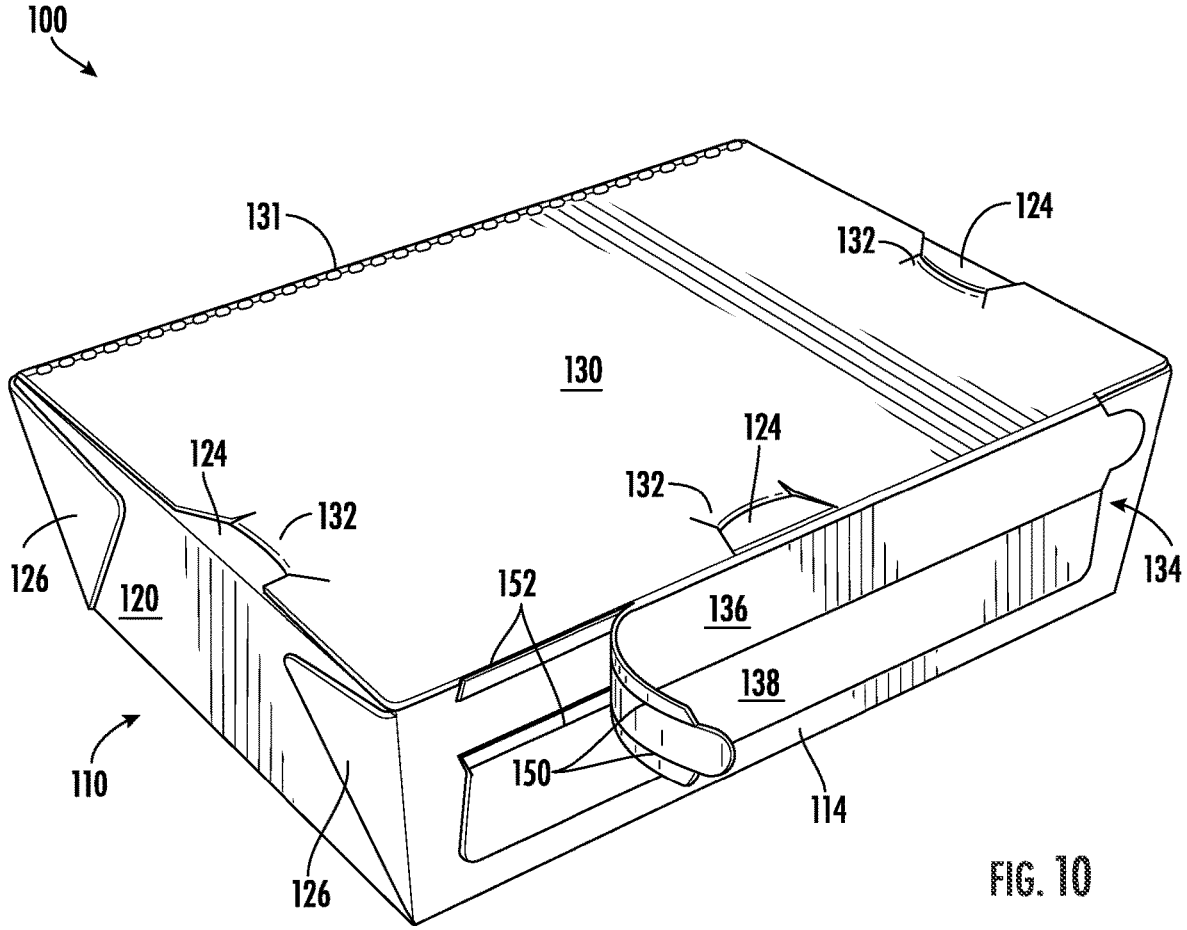
Figure 11:
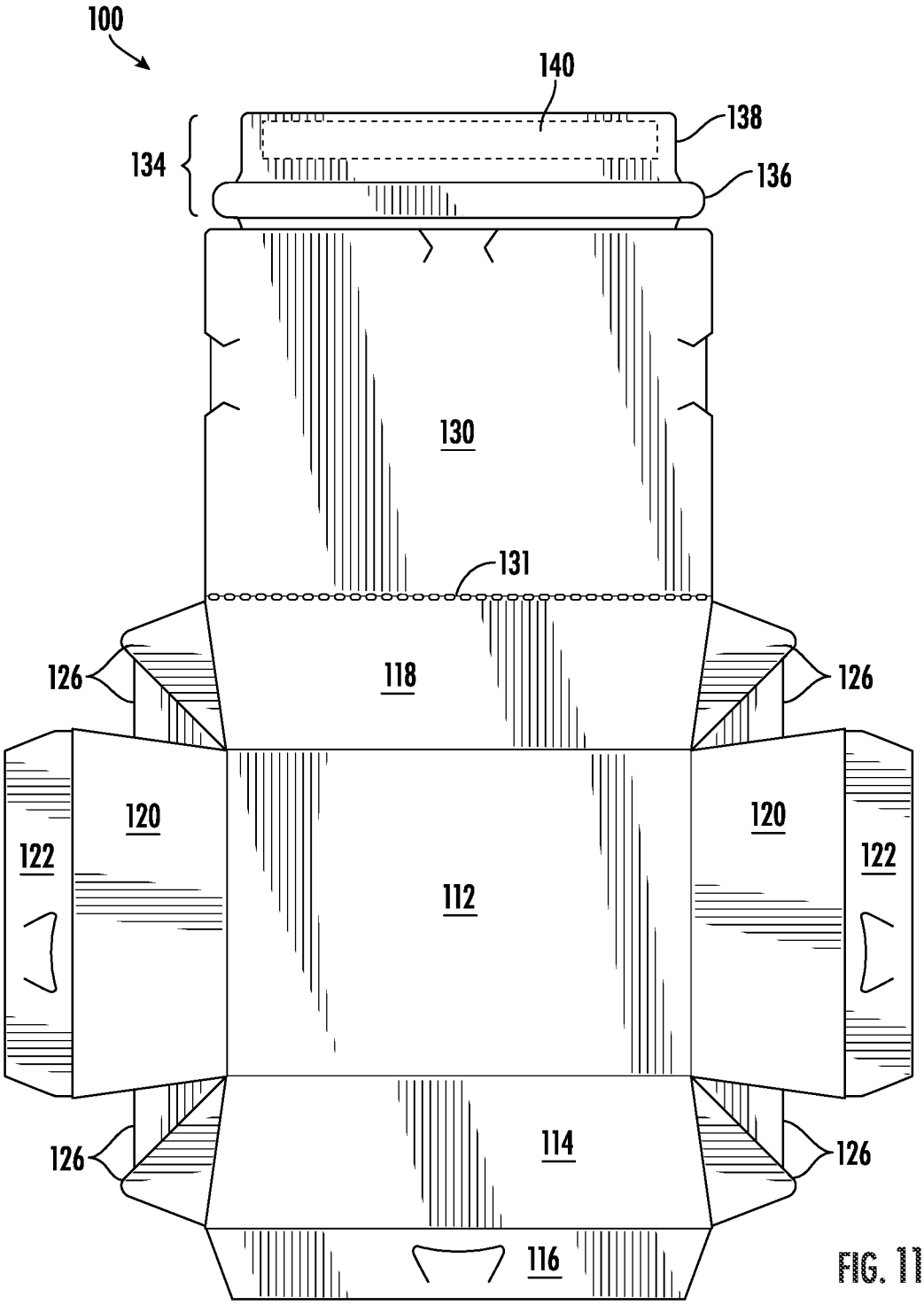
Figure 12:
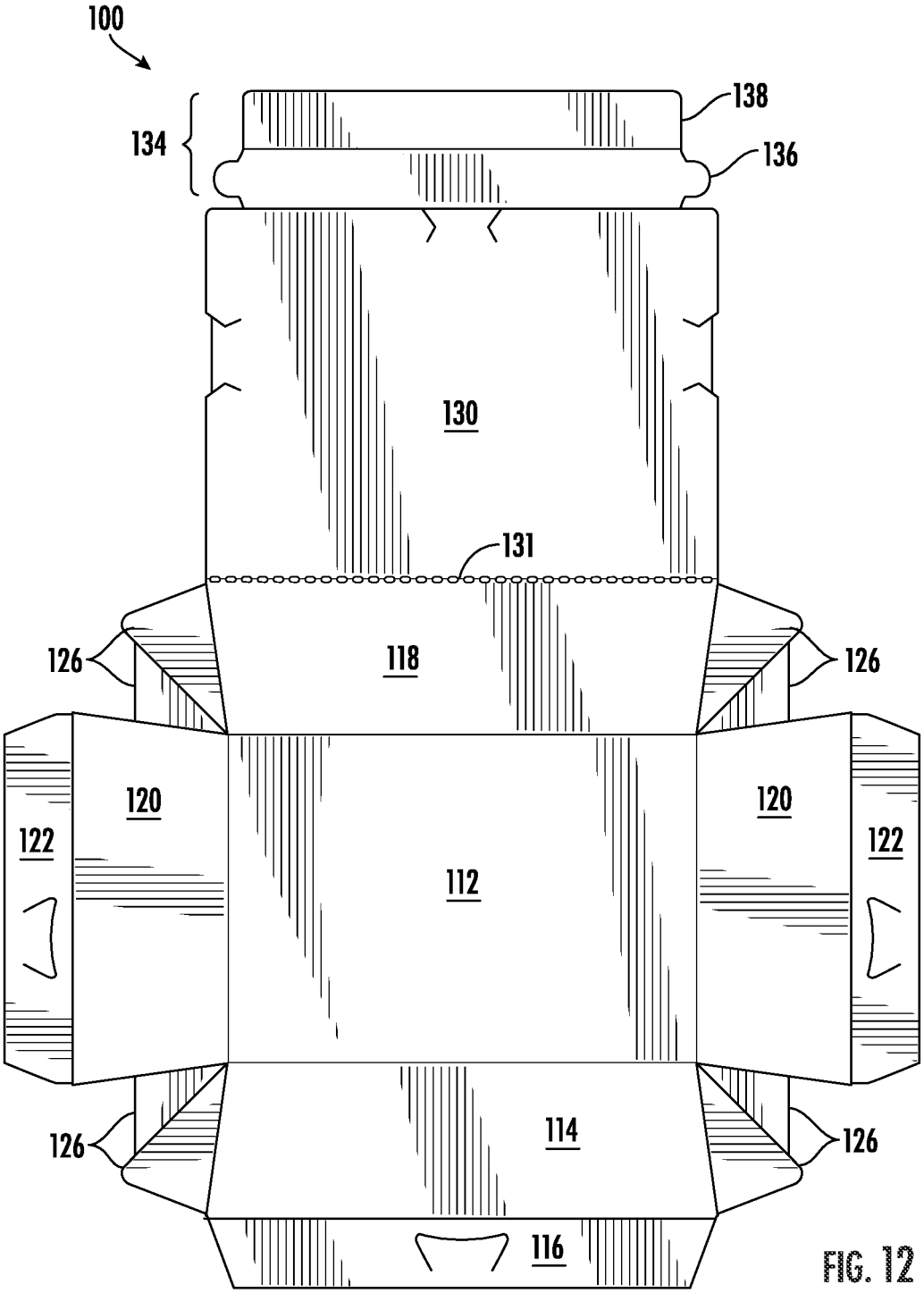
Figure 13:
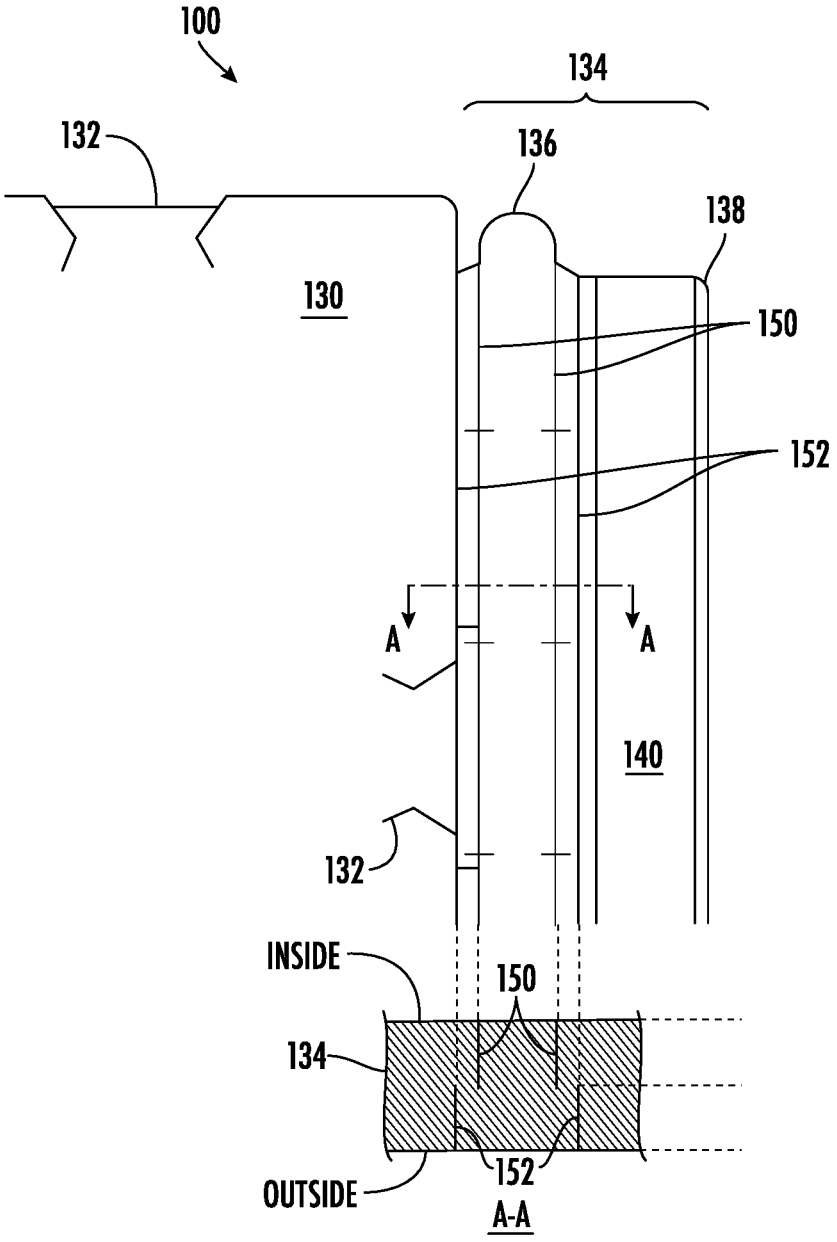
Figure 14:
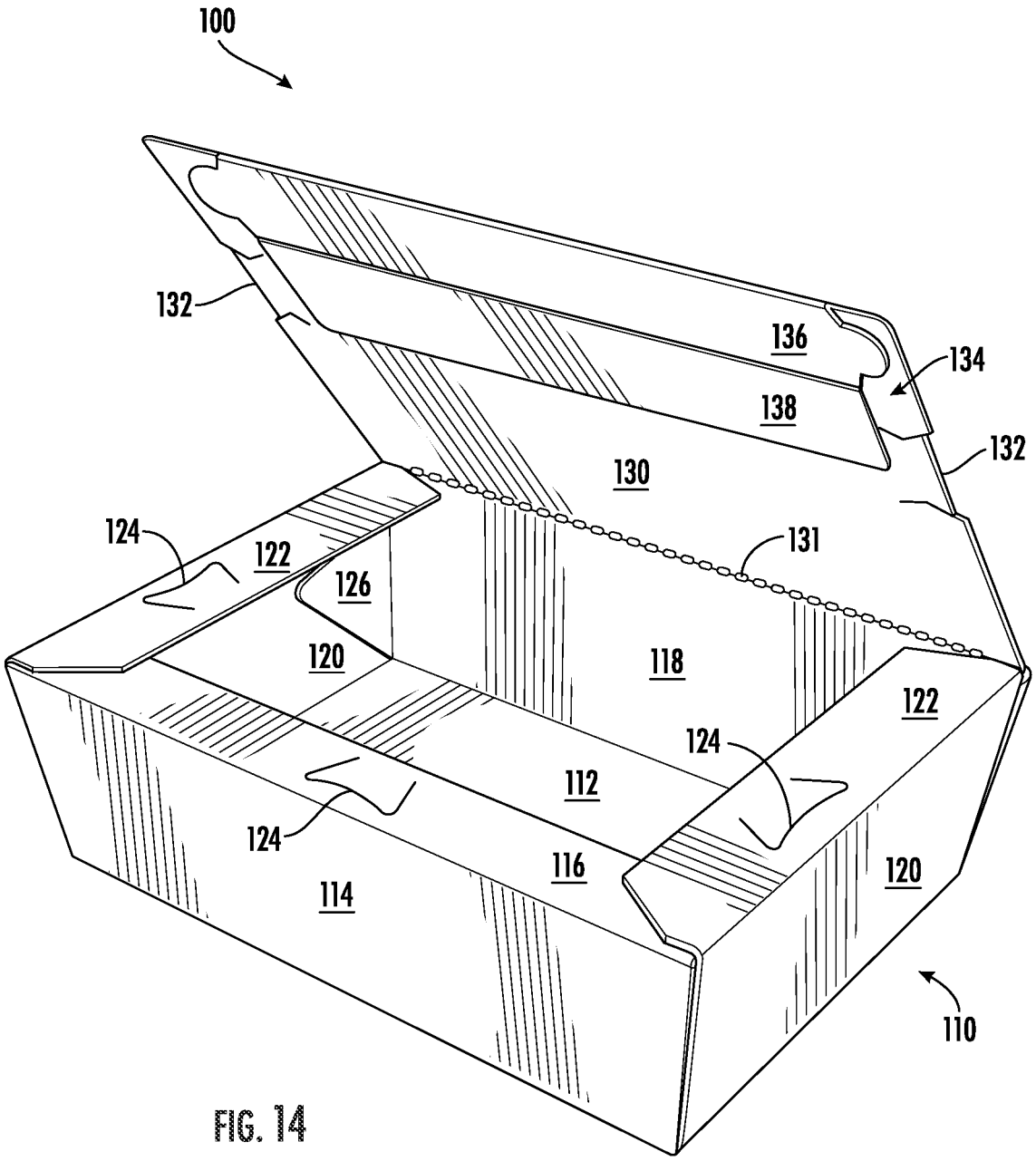
Figure 15:
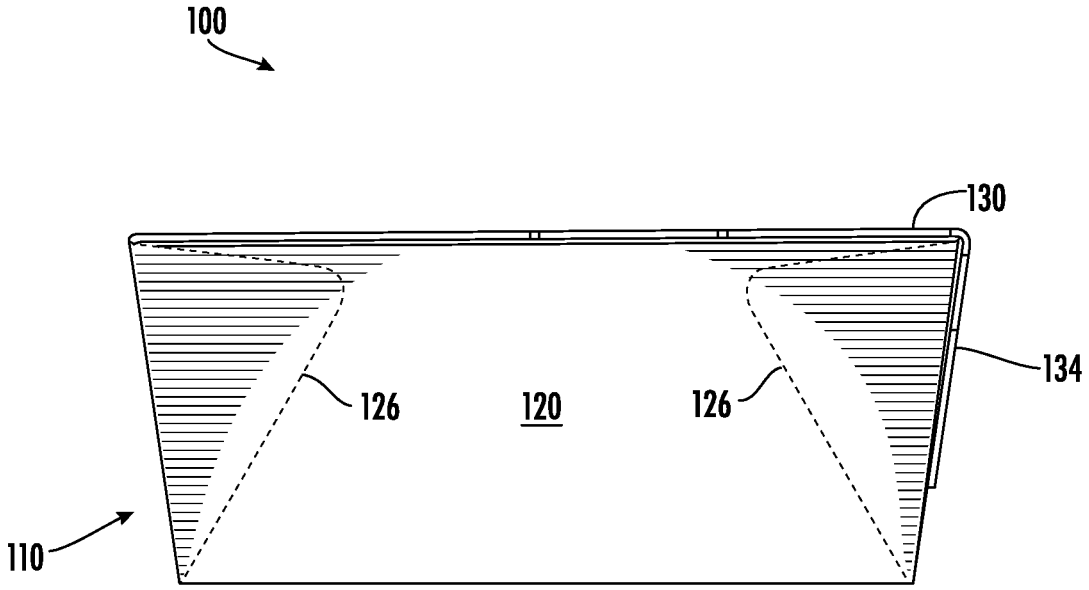
Figure 18:
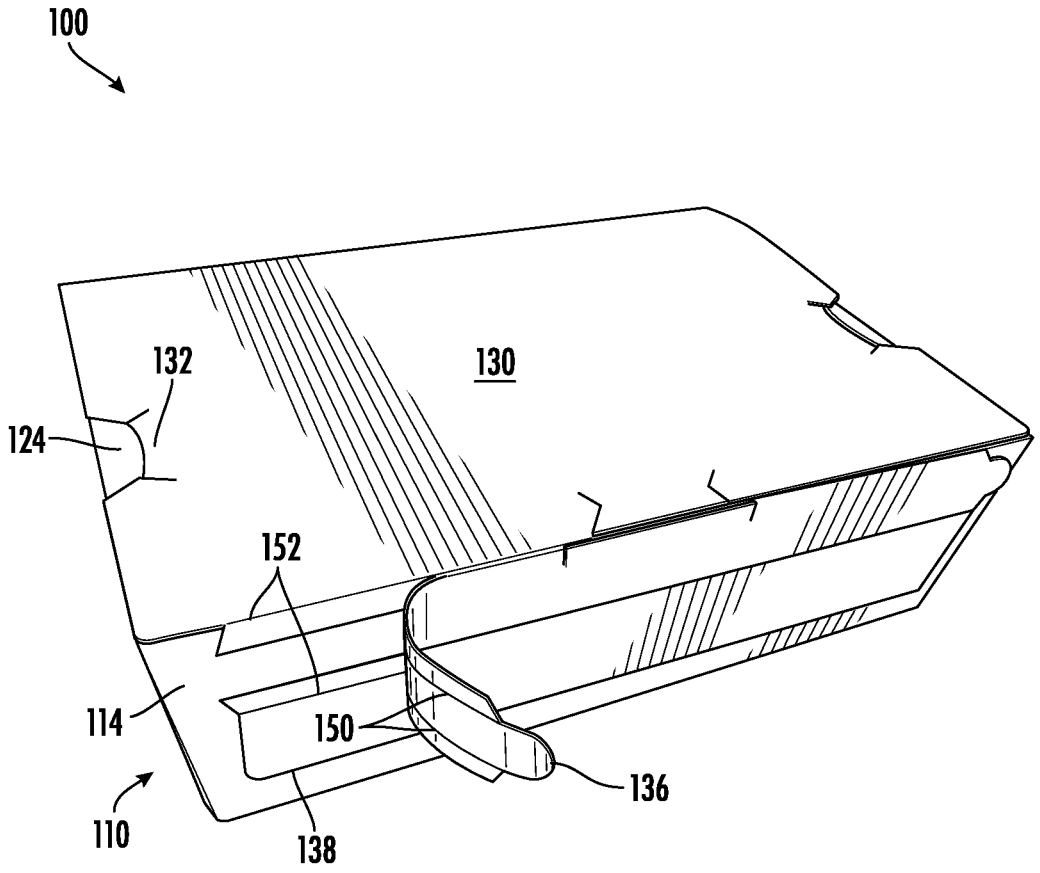
Figure 19:
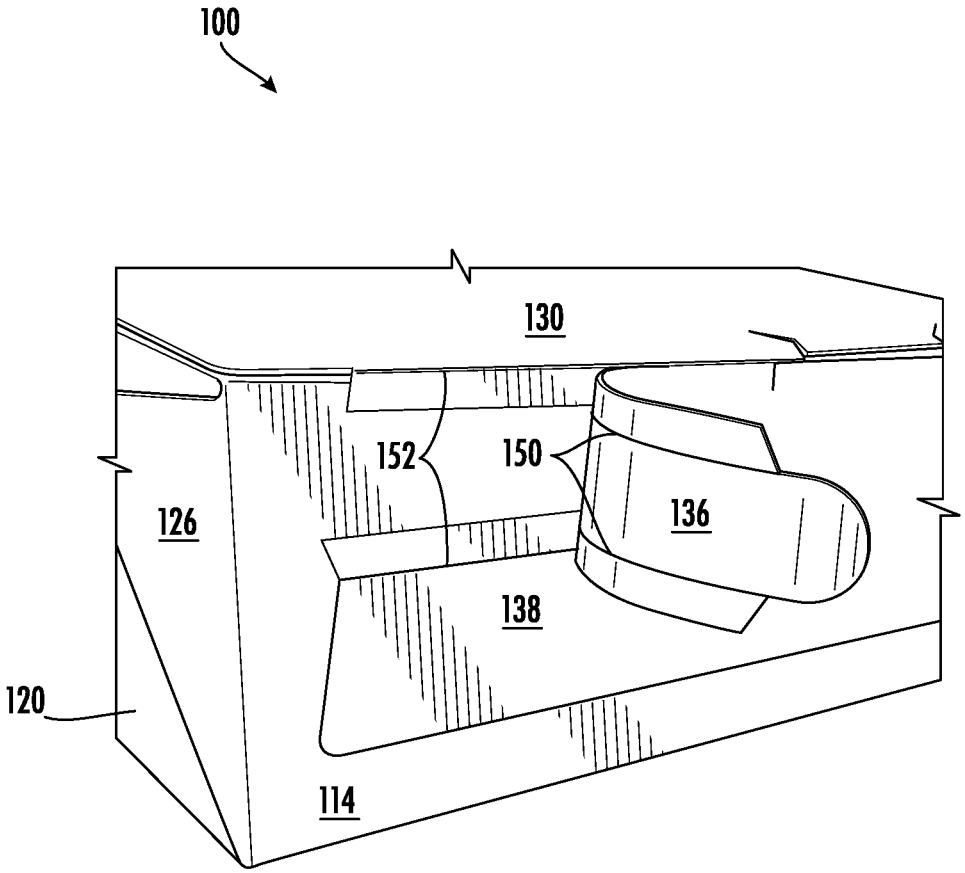
Figure 20:
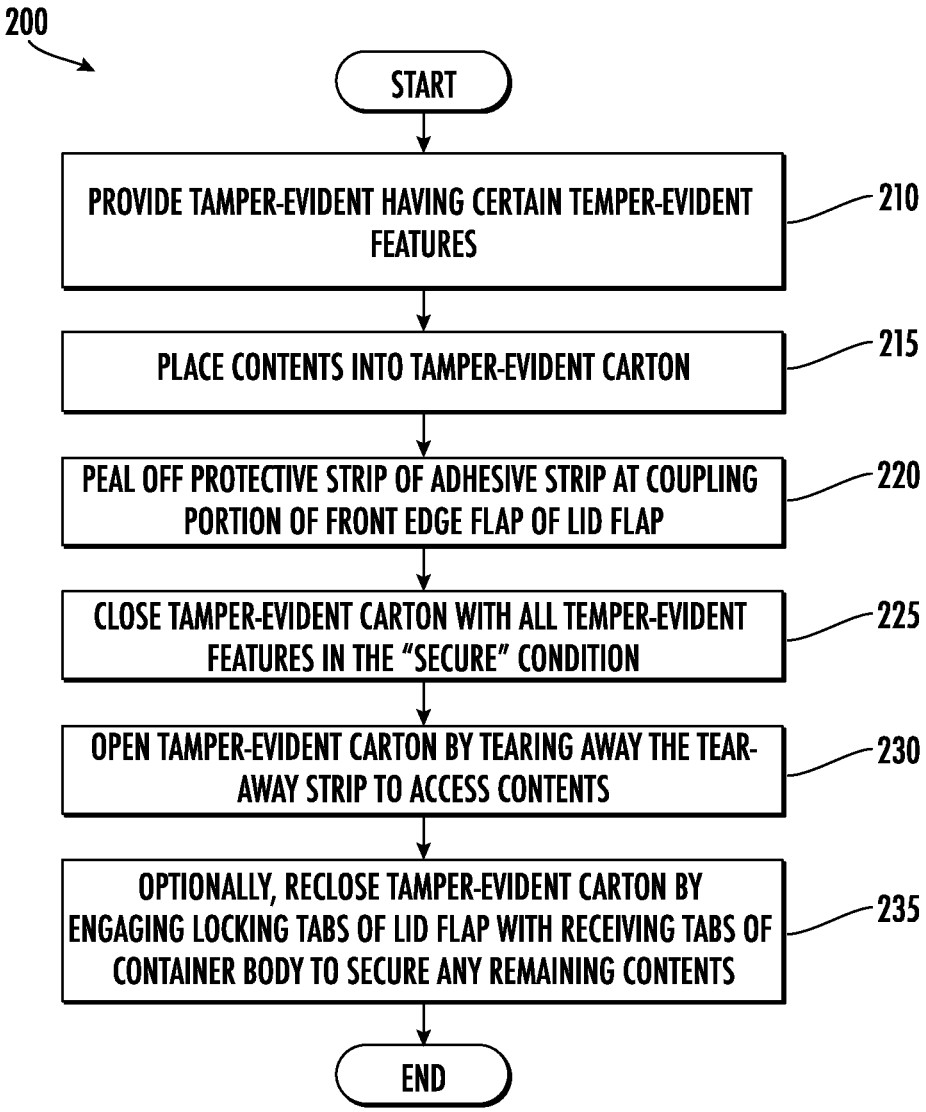

Having thus described the subject matter in general terms, reference will now be made to the accompanying drawings, which are not necessarily drawn to scale, and wherein:

FIG. 1 through FIG. 3 illustrate various perspective views of an example of a tamper-evident carton (or container) in an open un-secured position, in accordance with an embodiment of the invention;

FIG. 4 illustrates a perspective view of an example of the tamper-evident carton shown in a closed secured position, in accordance with an embodiment of the invention;

FIG. 5, FIG. 6, FIG. 7, FIG. 8, and FIG. 9 illustrate a front view, a back view, an end view, a top view, and a bottom view, respectively, of the tamper-evident carton shown in FIG. 4, in accordance with an embodiment of the invention;

FIG. 10 illustrates a perspective view of an example of the tamper-evident carton shown in FIG. 4 with a tear-away strip partially torn away, in accordance with an embodiment of the invention;

FIG. 11 and FIG. 12 illustrate plan views showing the tamper-evident carton in a flat pre-folded configuration, in accordance with an embodiment of the invention;

FIG. 13 illustrates a plan view showing more details of the tamper-evident feature of the tamper-evident carton, in accordance with an embodiment of the invention;

FIG. 14 illustrates a perspective view showing another configuration of the web corners of the tamper-evident carton of FIG. 1, in accordance with an embodiment of the invention;

FIG. 15 illustrates an end view showing another configuration of the web corners of the tamper-evident carton of FIG. 4, in accordance with an embodiment of the invention;

FIG. 16 through FIG. 19 illustrate various views of an example of the tamper-evident carton in various positions, in accordance with embodiments of the invention; and FIG. 20 illustrates a flow diagram of an example of a method of using the tamper-evident carton shown in FIG. 1 through FIG. 19, in accordance with an embodiment of the invention.

DETAILED DESCRIPTION

The subject matter now will be described more fully hereinafter with reference to the accompanying drawings, in which some, but not all embodiments of the subject matter are shown. Like numbers refer to like elements throughout. The subject matter may be embodied in many different forms and should not be construed as limited to the embodiments set forth herein; rather, these embodiments are provided so that this disclosure will satisfy applicable legal requirements. Indeed, many modifications and other embodiments of the subject matter set forth herein will come to mind to one skilled in the art to which the subject matter pertains having the benefit of the teachings presented in the foregoing descriptions and the associated drawings. Therefore, it is to be understood that the subject matter is not to be limited to the specific embodiments disclosed and that modifications and other embodiments are intended to be included within the scope of the appended claims.

In some embodiments, the subject matter of the present invention provides a carton with tamper-evident feature and method of using same. In one example, the tamper-evident food carton (or container) may be a disposable tamper-evident food carton that is, for example, a cardboard-, paper-, and/or paperboard-based container.

In some embodiments, the tamper-evident carton (or container) may include a container body and a foldable lid flap, and wherein the container body includes a floor panel, a front panel, a back panel, and two side panels that may be coupled via webbed corners. Accordingly, the tamper-evident carton may be used as, for example, a disposable food carry-out (or take-out) container that is suitable for holding wet foods reliably for some useful period of time.

In some embodiments, the webbed corners of the tamper-evident carton (or container) may be held by glue or other adhesive.

In some embodiments, the webbed corners of the tamper-evident carton (or container) may be configured on the outside of the tamper-evident carton.

In some embodiments, the webbed corners of the tamper-evident carton (or container) may be configured on the inside of the tamper-evident carton.

In some embodiments, the container body and/or hinged container lid of the tamper-evident carton (or container) may include various tabs and slots that may be engaged for holding shut the four container lid flaps to the container body.

In some embodiments, the container body and/or the lid flap of the tamper-evident carton (or container) may include one of more tamper-evident features that may be used to indicate a "secure" condition of the container and wherein the tamper-evident feature may be, for example, the condition of certain closure mechanisms (e.g., flaps, tabs, and/or slots), a perforated tear line, a tear-away strip, and/or the like.

In some embodiments, the container body and/or the lid flap of the tamper-evident carton (or container) may include tear-away strip, which is one example of a tamper-evident feature, and wherein the tear-away strip provides a substantially smooth tear line.

In some embodiments, the container body and/or the lid flap of the tamper-evident carton (or container) may include tear-away strip, which is one example of a tamper-evident feature, and wherein the tear-away strip may be formed using perforation lines on either side of the tear-away strip, or by forming an about 50% cut score line on the inside of the carton and an about 50% cut score line on the outside of the carton on either side of the tear-away strip and wherein the inside and outside cut score lines may be offset by about ⅛ inches.

Additionally, a method of using the carton (or container) with a tamper-evident feature is provided.

Figure 5:
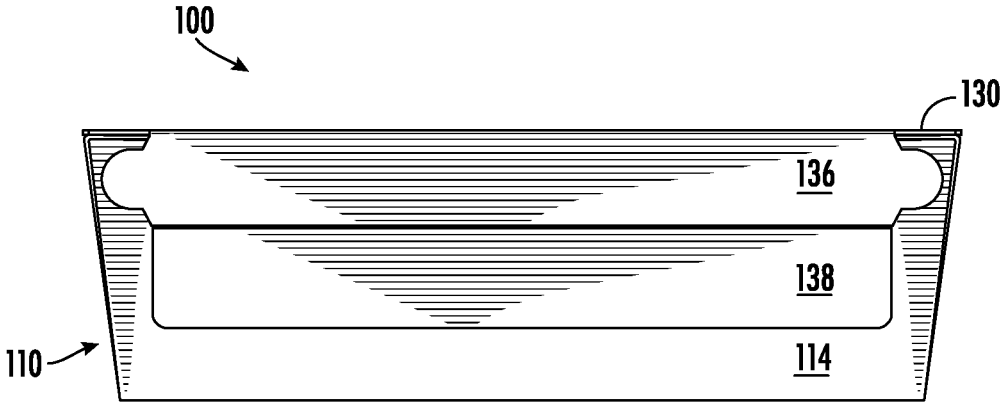
Figure 6:
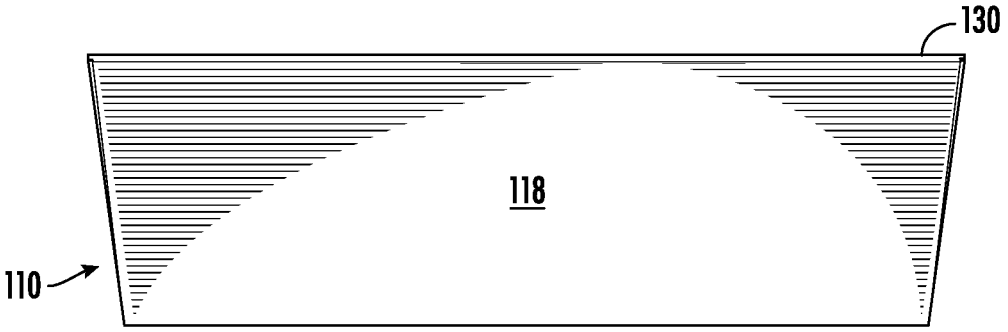
Figure 7:
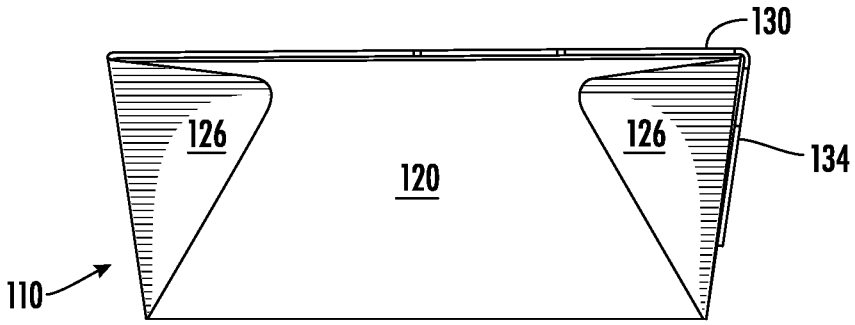
Figure 8:
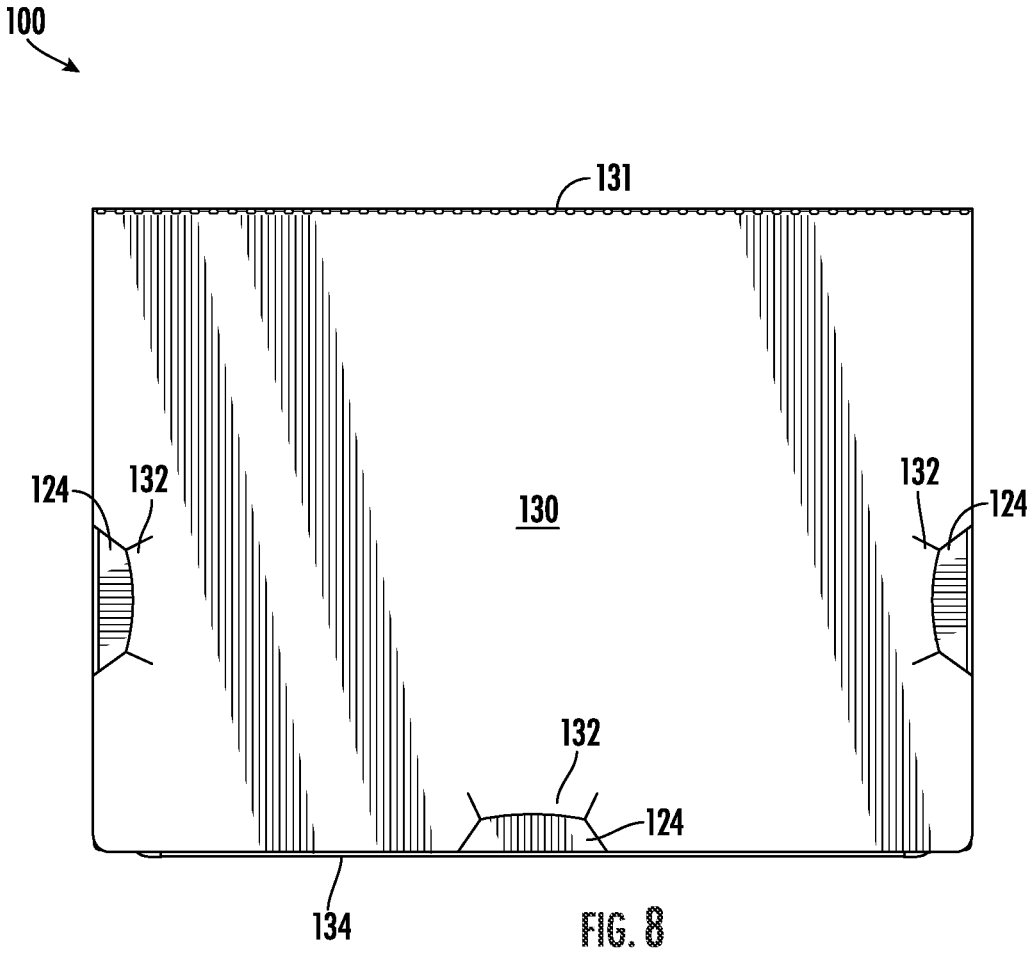
Figure 9:
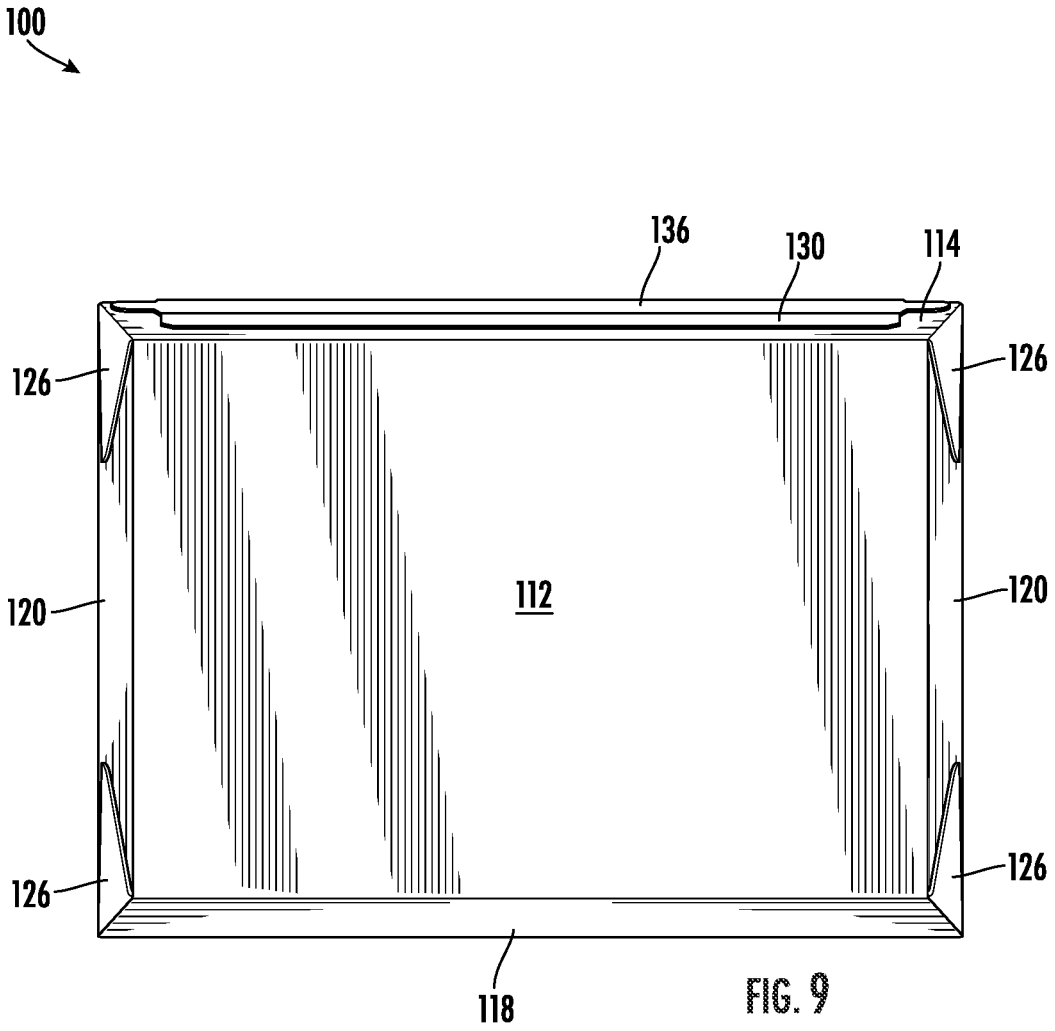

Referring now to FIG. 1 through FIG. 9 is various views of an example of the tamper-evident carton (or container) 100, in accordance with embodiments of the invention. For example, FIG. 1, FIG. 2, and FIG. 3 shows various perspective views of tamper-evident carton 100 in the open state. Further, FIG. 4 shows a perspective view, FIG. 5 shows a front view, FIG. 6 shows a back view, FIG. 7 shows an end view, FIG. 8 shows a top view, and FIG. 9 shows a bottom view of tamper-evident carton 100 in a closed secured state.

Referring still to FIG. 1 through FIG. 9, tamper-evident carton 100 may include a container body 110 and a lid flap 130. Container body 110 may include a floor panel 112, a front panel 114 that may have a top edge flap 116, a back panel 118, and two opposing side (or end) panels 120 and each may have a top edge flap 122. Further, each of the top edge flaps 116 and 122 may have a receiving tab 124. Further, lid flap 130 may be foldably coupled to container body 110. For example, lid flap 130 may be foldably coupled to a top edge of back panel 118 and may include a perforated tear (or fold) line 131. Accordingly, if desired, lid flap 130 may be torn off at its hinge via the perforated tear (or fold) line 131. Further, lid flap 130 may have locking tabs 132, for example, one locking tab 132 in the front of lid flap 130 and one on each side. Locking tabs 132 of lid flap 130 are designed to engage with receiving tabs 124 of container body 110, as shown, for example, in FIG. 4, FIG. 8, and FIG. 18.

Figure 16:
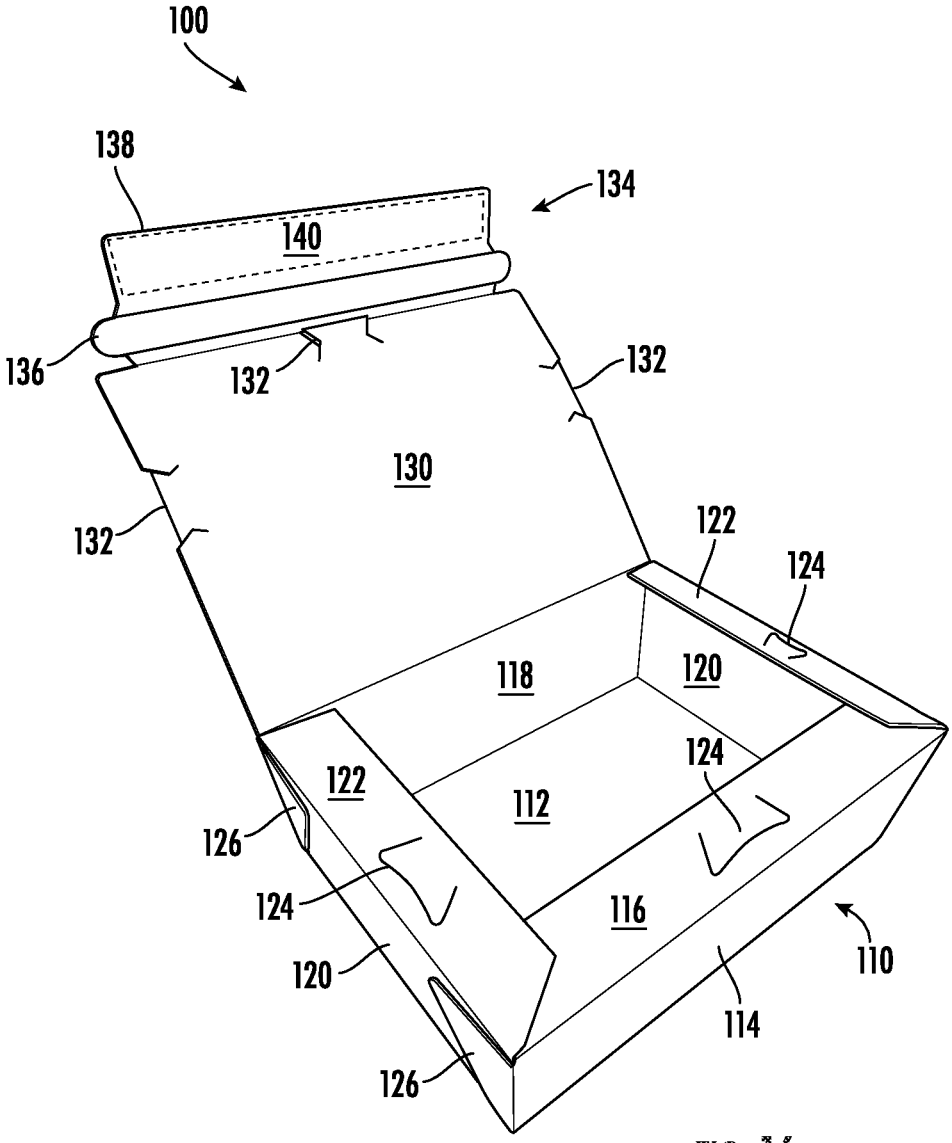

Further, the ends of front panel 114 and back panel 118 may be coupled to side panels 120 via webbed corners 126. The webbed corners 126 may be, for example, a webbed corner outside (or inside) glue design. An example of webbed corner outside glue design is shown in FIG. 1 through FIG. 10. An example of webbed corner inside glue design is shown in FIG. 15 and FIG. 16. The webbed corners 126 may be secured, for example, via an adhesive, thermal bonding, or any other suitable technique or mechanism.

Further, lid flap 130 may have a front edge flap 134. Front edge flap 134 may have both a tear-away strip portion 136 and a coupling portion 138. Further, coupling portion 138 may be affixable to front panel 114 of container body 110 via, for example, an adhesive strip 140 (see FIG. 11, FIG. 17) or any other suitable technique or mechanism.

With respect to tamper-evident carton 100 being, for example, a disposable tamper-evident food container, tamper-evident carton 100 may be formed of any lightweight, rigid or semi-rigid material that is suitable for holding and/or transporting, for example, a quantity of food and that is also suitable for disposing of after use. For example, tamper-evident carton 100 can be formed of corrugated cardboard, paper, paperboard, post-consumer paperboard (i.e., recycled materials), biodegradable materials (e.g., sugarcane and paper), polystyrene foam (e.g., Styrofoam), plastic, molded fiber, and the like.

Tamper-evident carton 100 may include certain tamper-evident features that may be used to indicate a "secure" and/or "tamper-evident" unsecure condition. The tear-away strip portion 136 of front edge flap 134 is an example of the tamper-evident features of the tamper-evident carton 100. In one example, when the tear-away strip portion 136 of front edge flap 134 is fully intact, the tamper-evident carton 100 is in the "secure" condition, as shown, for example, in FIG. 4. By contrast, when the tear-away strip portion 136 of front edge flap 134 is shown to be compromised, the tamper-evident carton 100 is in a "tamper-evident" condition. For example, FIG. 10 is a perspective view of an example of the tamper-evident carton 100 with tear-away strip portion 136 of front edge flap 134 partially torn away and therefore in a "tamper-evident" condition.

In another example, when locking tabs 132 of lid flap 130 and/or receiving tabs 124 of container body 110 are fully intact and fully engaged, the tamper-evident carton 100 is in the "secure" condition. By contrast, when any one or more of the locking tabs 132 of lid flap 130 and/or receiving tabs 124 of container body 110 is shown to be compromised (e.g., torn, partially or fully missing, and/or not fully engaged), the tamper-evident carton 100 is in a "tamper-evident" condition.

Referring now to FIG. 11 and FIG. 12 is plan views showing tamper-evident carton 100 shown in FIG. 1 through FIG. 4 in a flat pre-folded configuration. With respect to forming, for example, paperboard products, this flat pre-folded configuration is also called a "blank." FIG. 11 shows an inside plan view and FIG. 12 shows an outside plan view of tamper-evident carton 100. Further, FIG. 11 shows an example of the placement of adhesive strip 140 at coupling portion 138 of front edge flap 134.

Referring now to FIG. 14 is a plan view showing yet more details of the tamper-evident feature of the tamper-evident carton 100 shown in FIG. 1 through FIG. 4. For example, with respect to tear-away strip portion 136 of front edge flap 134 of lid flap 130, which is a tamper-evident feature, certain score cuts are provided to facilitate tearing. Namely, a pair of cut score lines 150 and a pair of cut score lines 152. In one example, cut score lines 150 form the side boundaries of tear-away strip portion 136 of front edge flap 134. Cut score lines 150 are flanked on each side by a cut score line 152, which may be about an ⅛ inch away.

Further, and referring now to a cross-section A-A of FIG. 14, cut score lines 150 may be cut about 50% through from the inside of the material. By contrast, cut score lines 152 may be cut about 50% through from the outside of the material. All to facilitate tearing as shown, for example, in FIG. 10, FIG. 19, and FIG. 20.

Alternatively, tear-away strip portion 136 of lid flap 130 may be formed using a pair of perforation lines on either side of tear-away strip portion 136.

Referring now to FIG. 15 and FIG. 16 is a perspective view and an end view, respectively, showing another configuration of webbed corners 126 of tamper-evident carton 100 shown in FIG. 1 through FIG. 4. In this example, a webbed corner inside glue design is shown. Again, webbed corners 126 may be secured, for example, via an adhesive, thermal bonding, or any other suitable technique or mechanism.

Figure 17:
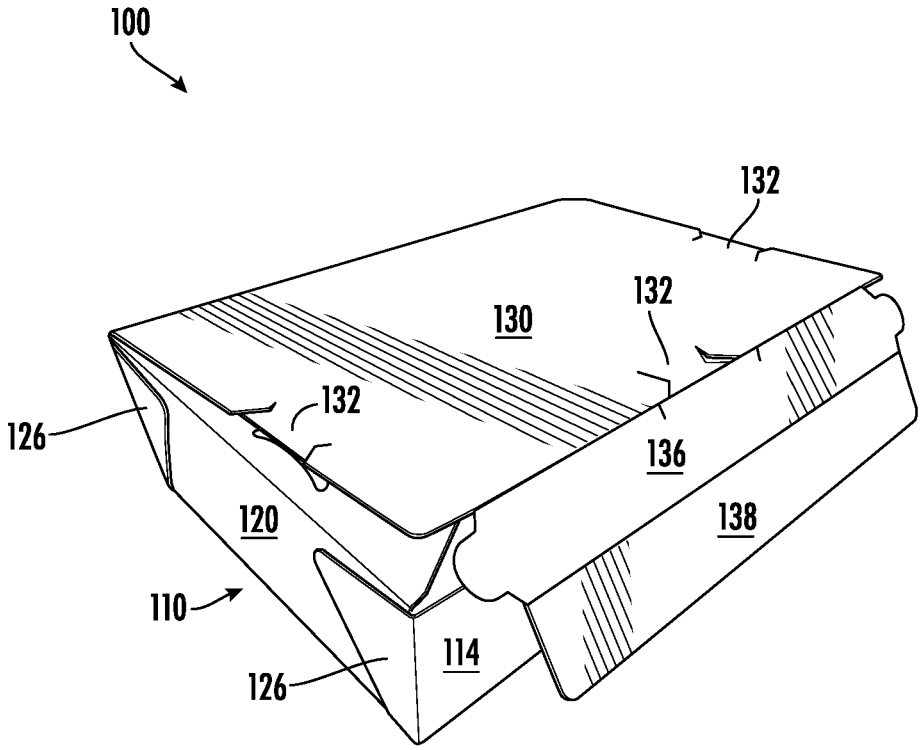

Referring now to FIG. 17 through FIG. 19 show various views of an example of a tamper-evident carton 100, in accordance with an embodiment of the invention.

Referring now to FIG. 22 is a flow diagram of an example of a method 200 of using the tamper-evident carton 100 shown in FIG. 1 through FIG. 21, in accordance with an embodiment of the invention. Method 200 may include, but is not limited to, the following steps, or the their particular order.

At a step 210, a tamper-evident carton is provided that includes a container body and a foldable lid flap that has certain temper-evident features. For example, tamper-evident carton 100 may be provided that includes container body 110 and foldable lid flap 130 and that has certain temper-evident features, as shown, for example, in FIG. 1 through FIG. 19. An example of a temper-evident feature of tamper-evident carton 100 may be tear-away strip portion 136 of front edge flap 134 of lid flap 130.

At a step 215, any contents may be placed into the tamper-evident carton. For example, food may be placed into container body 110 of tamper-evident carton 100.

At a step 220, a protective strip of the adhesive strip at the coupling portion of the front edge flap of the lid flap may be peeled off to expose the adhesive. For example, a protective strip (not shown) of adhesive strip 140 at coupling portion 138 of front edge flap 134 of lid flap 130 may be peeled away to expose the adhesive thereon.

At a step 225, the tamper-evident carton is closed with all the temper-evident features in the "secure" condition. For example, lid flap 130 may be folded down onto container body 110. Then, side locking tabs 132 of lid flap 130 may be engaged with the side receiving tabs 124 of container body 110. Optionally, the front locking tab 132 of lid flap 130 may be engaged with the front receiving tab 124 of container body 110. Then, front edge flap 134 of lid flap 130 may be folded against front panel 114 of container body 110 of tamper-evident carton 100. Then, coupling portion 138 of front edge flap 134 of lid flap 130 may be adhered by pressing adhesive strip 140 against front panel 114 of container body 110. The tamper-evident carton 100 is now fully closed and in the "secure" condition.

At a step 230, the tamper-evident carton is opened by tearing away the tear-away strip. Then, the contents of the tamper-evident carton may be accessed. For example, tamper-evident carton 100 may be opened by tearing away the tear-away strip portion 136 of front edge flap 134 of lid flap 130, as shown, for example, in FIG. 10, FIG. 19, and FIG. 20. Once opened, the contents of tamper-evident carton 100 may be accessed. The tamper-evident carton 100 is now in the "tamper-evident" condition.

At an optional step 235, the tamper-evident carton may be reclosed by engaging the locking tabs of the lid flap with the receiving tabs of the container body to secure any remaining contents. For example, tamper-evident carton 100 may be reclosed by engaging locking tabs 132 of lid flap 130 with receiving tabs 124 of container body 110 to secure any remaining contents. The tamper-evident carton 100 is still in the "tamper-evident" condition because tear-away strip portion 136 of front edge flap 134 of lid flap 130 has been and remains compromised. Further, at any point in the lifetime of tamper-evident carton 100, the tamper-evident carton 100 may be discarded.

In summary and referring now again to FIG. 1 through FIG. 19, the tamper-evident carton 100 and method 200 of using the tamper-evident carton 100 are provided. In one example, the tamper-evident food container 100 may be a disposable tamper-evident food container that is, for example, a cardboard-, paper-, and/or paperboard-based container. In one example, the tamper-evident carton 100 and method 200 may provide certain tamper-evident features, such as, but not limited to, perforated tear (or fold) line 131 of lid flap 130, tear-away strip portion 136 of front edge flap 134 of lid flap 130, locking tabs 132 of lid flap 130, and/or receiving tabs 124 of container body.

Additionally, the tamper-evident carton 100 and method 200 features a tear-away strip portion 136 of lid flap 130 that provides a substantially smooth tear line. For example, tear-away strip portion 136 of lid flap 130 may be formed using a pair of about 50% cut score lines 150 on the inside of the carton and a pair of about 50% cut score lines 152 on the outside of the carton and wherein the inside and outside cut score lines may be offset by about ⅛ inches. Alternatively, tear-away strip portion 136 of lid flap 130 may be formed using a pair of perforation lines on either side of tear-away strip portion 136.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A tamper evident carton, comprising:

a. a floor panel;

b. side panels extending about a periphery of the floor panel, wherein the side panels comprise a front side panel, an opposing rear side panel, a first end panel, and an opposing second end panel, and wherein the front side panel comprises a front side top edge flap and the opposing first and second end panels comprise a first end top edge flap and a second end top edge flap, respectively, wherein the front side top edge flap, the first end top edge flap, and the second end top edge flap are hingedly connected to a top edge of their respective panel, and wherein one or more of the front side top edge flap, first end top edge flap, and second end top edge flap comprise a receiving tab formed therein;

c. corner gussets extending between adjacent side panels, wherein the floor panel, side panels, and corner gussets are configurable to form a compartment region;

d. a lid flap extending from an uppermost edge of the rear side panel forming a moveable hinge joint therebetween, the lid flap comprising a front edge flap extending from a front edge of the lid flap opposite that of the moveable hinge joint;

e. a tear strip disposed in the front edge flap; and wherein the front edge flap further comprises a coupling portion, wherein the coupling portion is configured to affix to at least a portion of an outer facing surface of the front side panel, and wherein the tear strip extends a length of the front edge flap and is disposed between the coupling portion and the front edge of the lid flap.

2. The tamper evident carton of claim 1, wherein the lid flap comprises one or more locking tabs, wherein the one or more locking tabs are configured to engage with the receiving tab of one or more of the front side top edge flap, first end top edge flap, and second end top edge flap.

3. The tamper evident carton of claim 2, wherein the one or more locking tabs are configured to be interlockable with a corresponding receiving tab of one or more of the front side top edge flap, first end top edge flap, and second end top edge flap when the lid flap is in a closed configuration.

4. The tamper evident carton of claim 3, wherein once interlocked the interlocked locking tab and receiving tab are configured such that the locking tab cannot be removed from the receiving tab without causing visible damage to at least one of the locking tab and the receiving tab.

5. The tamper evident carton of claim 1, wherein the moveable hinge joint formed between the lid flap and the uppermost edge of its respective side panel is perforated.

6. The tamper evident carton of claim 1, further comprising a first score line and a second score line, wherein the first score line and the second score line define side boundaries of the tear strip, and wherein each of the first score line and the second score line are flanked by a third score line and a fourth score line, respectively.

7. The tamper evident carton of claim 6, wherein the first score line and the second score line are cut about fifty percent (50%) through from an inside surface of the front edge flap, and wherein the third score line and the fourth score line are cut about fifty percent (50%) through from an outside surface of the front edge flap.

8. The tamper evident carton of claim 7, wherein upon removal of the tear strip the coupling portion is separated from the front edge of the lid flap.

9. The tamper evident carton of claim 1, wherein the coupling portion is affixable to the front side panel via an adhesive.

10. A method of securing contents in a tamper evident carton, comprising:

a. providing a tamper evident carton, comprising:

i. a floor panel;

ii. side panels extending about a periphery of the floor panel, wherein the side panels comprise a front side panel, an opposing rear side panel, a first end panel, and an opposing second end panel, and wherein the front side panel comprises a front side top edge flap and the opposing first and second end panels comprise a first end top edge flap and a second end top edge flap, respectively, wherein the front side top edge flap, the first end top edge flap, and the second end top edge flap are hingedly connected to a top edge of their respective panel, and wherein one or more of the front side top edge flap, first end top edge flap, and second end top edge flap comprise a receiving tab formed therein;

iii. corner gussets extending between adjacent side panels, wherein the floor panel, side panels, and corner gussets are configurable to form a compartment region;

iv. a lid flap extending from an uppermost edge of the rear side panel forming a moveable hinge joint therebetween, the lid flap comprising a front edge flap extending from a front edge of the lid flap opposite that of the moveable hinge joint;

v. a tear strip disposed in the front edge flap; and wherein the front edge flap further comprises a coupling portion, wherein the coupling portion is configured to affix to at least a portion of an outer facing surface of the front side panel, and wherein the tear strip extends a length of the front edge flap and is disposed between the coupling portion and the front edge of the lid flap;

b. inserting contents into the compartment region;

c. folding the lid flap to a closed position; and d. securing the front edge flap to a side panel opposite that of the side panel from which the front edge flap extends from.

11. The method of claim 10, wherein the side panels of the tamper evident carton comprise a front side panel, an opposing rear side panel, a first end panel, and an opposing second end panel, and wherein the lid flap extends from an uppermost edge of the rear side panel.

12. The method of claim 11, wherein the front edge flap further comprises a coupling portion, wherein the coupling portion is configured to affix to at least a portion of an outer facing surface of the front side panel, and wherein the tear strip extends a length of the front edge flap and is disposed between the coupling portion and the front edge of the lid flap.

13. The method of claim 10, wherein the front side panel comprises a front side top edge flap and the opposing first and second end panels comprise a first end top edge flap and a second end top edge flap, respectively, wherein the front side top edge flap, the first end top edge flap, and the second end top edge flap are hingedly connected to a top edge of their respective panel, and wherein one or more of the front side top edge flap, first end top edge flap, and second end top edge flap comprise a receiving tab formed therein.

14. The method of claim 13, wherein the lid flap comprises one or more locking tabs, and wherein the one or more locking tabs are configured to engage with the receiving tab of one or more of the front side top edge flap, first end top edge flap, and second end top edge flap.

15. The method of claim 14, further comprising interlocking one or more of the one or more locking tabs with a corresponding receiving tab of one or more of the front side top edge flap, first end top edge flap, and second end top edge flap.

16. The method of claim 10, wherein the tear strip comprises a first score line and a second score line defining side boundaries thereof, and wherein each of the first score line and the second score line are flanked by a third score line and a fourth score line, respectively.

17. The method of claim 16, wherein the first score line and the second score line are cut about fifty percent (50%) through from an inside surface of the front edge flap, and wherein the third score line and the fourth score line are cut about fifty percent (50%) through from an outside surface of the front edge flap.

18. A method of providing access to contents in a secured tamper evident carton, comprising:

a. providing a secured tamper evident carton with contents therein, the tamper evident carton comprising:
   i. a floor panel;
   ii. side panels extending about a periphery of the floor panel, wherein the side panels comprise a front side panel, an opposing rear side panel, a first end panel, and an opposing second end panel, and wherein the front side panel comprises a front side top edge flap and the opposing first and second end panels comprise a first end top edge flap and a second end top edge flap, respectively, wherein the front side top edge flap, the first end top edge flap, and the second end top edge flap are hingedly connected to a top edge of their respective panel, and wherein one or more of the front side top edge flap, first end top edge flap, and second end top edge flap comprise a receiving tab formed therein;
   iii. corner gussets extending between adjacent side panels, wherein the floor panel, side panels, and corner gussets are configurable to form a compartment region;
   iv. a lid flap extending from an uppermost edge of the rear side panel forming a moveable hinge joint therebetween, the lid flap comprising a front edge flap extending from a front edge of the lid flap opposite that of the moveable hinge joint;
   V. a tear strip disposed along a length of the front edge flap; and
   wherein the front edge flap further comprises a coupling portion, wherein the coupling portion is configured to affix to at least a portion of an outer facing surface of the front side panel, and wherein the tear strip extends a length of the front edge flap and is disposed between the coupling portion and the front edge of the lid flap;
b. removing the tear strip; and
c. folding open the lid flap.

19. The method of claim 18, wherein the side panels of the tamper evident carton comprise a front side panel, an opposing rear side panel, a first end panel, and an opposing second end panel, and wherein the lid flap extends from an uppermost edge of the rear side panel.

20. The method of claim 19, wherein the front edge flap further comprises a coupling portion, wherein the coupling portion is configured to affix to at least a portion of an outer facing surface of the front side panel, and wherein the tear strip extends a length of the front edge flap and is disposed between the coupling portion and the front edge of the lid flap.

21. The method of claim 18, wherein the front side panel comprises a front side top edge flap and the opposing first and second end panels comprise a first end top edge flap and a second end top edge flap, respectively, wherein the front side top edge flap, the first end top edge flap, and the second end top edge flap are hingedly connected to a top edge of their respective panel, and wherein one or more of the front side top edge flap, first end top edge flap, and second end top edge flap comprise a receiving tab formed therein.

22. The method of claim 21, wherein the lid flap comprises one or more locking tabs, and wherein the one or more locking tabs are configured to engage with the receiving tab of one or more of the front side top edge flap, first end top edge flap, and second end top edge flap.

23. The method of claim 22, further comprising, prior to folding open the lid flap, unlocking the one or more of the one or more locking tabs that are interlocked with a corresponding receiving tab of one or more of the front side top edge flap, first end top edge flap, and second end top edge flap.

24. The method of claim 18, wherein the tear strip comprises a first score line and a second score line defining side boundaries thereof, and wherein each of the first score line and the second score line are flanked by a third score line and a fourth score line, respectively.

25. The method of claim 24, wherein the first score line and the second score line are cut about fifty percent (50%) through from an inside surface of the front edge flap, and wherein the third score line and the fourth score line are cut about fifty percent (50%) through from an outside surface of the front edge flap.

26. The method of claim 25, wherein upon removal of the tear strip the coupling portion is separated from the front edge of the lid flap.

* * * * *